US011468831B2

(12) United States Patent
Chao et al.

(10) Patent No.: US 11,468,831 B2
(45) Date of Patent: Oct. 11, 2022

(54) LIGHT EMITTING DEVICE ARRAY CIRCUIT CAPABLE OF REDUCING GHOST IMAGE AND DRIVER CIRCUIT AND CONTROL METHOD THEREOF

(71) Applicant: Richtek Technology Corporation, Zhubei (TW)

(72) Inventors: Heng-Sheng Chao, Hsinchu (TW); Jia-Nan Tai, Kaohsiung (TW); Hsing-Shen Huang, Hsinchu (TW)

(73) Assignee: RICHTEK TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 17/575,580

(22) Filed: Jan. 13, 2022

(65) Prior Publication Data

US 2022/0223099 A1 Jul. 14, 2022

Related U.S. Application Data

(60) Provisional application No. 63/137,661, filed on Jan. 14, 2021.

(30) Foreign Application Priority Data

Jul. 21, 2021 (TW) ..... 110126877

(51) Int. Cl.
*G09G 3/32* (2016.01)

(52) U.S. Cl.
CPC ..... *G09G 3/32* (2013.01); *G09G 2310/0267* (2013.01); *G09G 2310/0291* (2013.01)

(58) Field of Classification Search
CPC ..... G09G 3/32; G09G 2310/0267; G09G 2310/0291
See application file for complete search history.

(56) References Cited

U.S. PATENT DOCUMENTS

2017/0186376 A1* 6/2017 Kuang ..... G09G 3/3275
2021/0201767 A1* 7/2021 Park ..... G09G 3/3233

* cited by examiner

*Primary Examiner* — Muhammad N Edun
(74) *Attorney, Agent, or Firm* — Tung & Associates

(57) ABSTRACT

A light emitting device array circuit capable of reducing ghost image includes: a light emitting device array, plural scan line switch circuits, and a driver circuit. The light emitting device array includes plural light emitting devices arranged in plural scan lines and plural data lines. In one frame, plural scan line switch circuits respectively electrically connect plural scan nodes in plural corresponding scan lines to a scan conduction voltage in a non-overlapping sequential order. Data line buffer circuits of the driver circuit provide predetermined dimming levels to corresponding data nodes respectively according to data operation signals. A pre-discharge control amplifier circuit of the driver circuit is coupled to the plural scan nodes and provides a pre-discharge level to at least one predetermined scan node during a predetermined pre-discharge time period according to a pre-discharge signal.

57 Claims, 24 Drawing Sheets

First performance pre-charge mode

LIGHT EMITTING DEVICE ARRAY CIRCUIT CAPABLE OF REDUCING GHOST IMAGE AND DRIVER CIRCUIT AND CONTROL METHOD THEREOF

CROSS REFERENCE

The present invention claims priority to U.S. 63/137661 filed on Jan. 14, 2021 and claims priority to TW 110126877 filed on Jul. 21, 2021.

BACKGROUND OF THE INVENTION

Field of Invention

The present invention relates to a light emitting device array circuit and a driver circuit and a control method thereof, and particularly to a light emitting device array circuit capable of reducing ghost image, and a driver circuit and a control method thereof.

Description of Related Art

FIG. 1A illustrates a schematic diagram of a conventional light emitting diode (LED) array circuit 100. As shown in FIG. 1A, the LED array circuit 100 includes an LED array 110, plural scan line switch circuits 120 and plural data line buffer circuits 130. The LED array 110 includes plural LED devices arranged in an array of plural scan lines N−1, N, N+1, N+2 and plural data lines Ch1, Ch2, Ch3, Ch4. The LED array circuit 100 operates as follows: in one frame, a scan conduction voltage Vdd is supplied to scan lines N−1, N, N+1, N+2 in the LED array 110 sequentially according to the listing order. Before the next scan line is turned ON, the scan conduction voltage Vdd is stopped from being provided to the present scan line. A predetermined dimming level DIM is provided to a predetermined data line at a proper time point, so as to turn ON a predetermined LED device in the LED array 110, such that a predetermined image is displayed.

For example, as shown in FIG. 1A, if the LED device A at the scan line N and the data line Ch3 is to be lit up in a certain frame, the scan line switch circuit 120 corresponding to the scan line N is controlled by a scan operation signal to be turned ON, so as to supply the scan conduction voltage Vdd to the scan line N. The data line buffer circuit 130 of the data line Ch3 is controlled by a data operation signal DOS at the same time to provide the predetermined dimming level DIM to the data line Ch3, so that an LED conduction current flows through the LED device A at the scan line N and the data line Ch3, whereby the LED device A emits light.

When the LED array circuit 100 operates, a problem which needs to be dealt with is the occurrences of "ghost images", including upper ghost image problem and lower ghost image problem. Please refer to FIG. 1B. One ghost image test method is to light up the LED devices in a diagonal line (as shown by the white dots) in the LED array 110 (indicated by the array formed by dots in FIG. 1B), to test whether a ghost image occurs in the LED array 110. During the test, if the LED devices (as shown by gray dots in FIG. 1B) above the LED devices in the diagonal line emits light slightly, it is referred to as the upper ghost image. The upper ghost image phenomenon results from a parasitic capacitance Cr in the scan line switch circuit 120.

More specifically, please refer to FIG. 1A, during the above-mentioned test, the scan operation signals control the scan line switch circuits 120 to supply the scan conduction voltage Vdd to the scan line N−1, the scan line N, the scan line N+1 and the scan line N+2 in sequence while the data operation signals DOS control the data line buffer circuit 130 to provide the predetermined dimming level DIM to the corresponding data line Ch4, the data line Ch3, the data line Ch2 and the data line Ch1 in sequence, so as to light up the corresponding LED devices at the scan line N−1 and the data line Ch4, at the scan line N and the data line Ch3, at the scan line N+1 and the data line Ch2, and at the scan line N+2 and the data line Ch1 in order.

For instance, after the scan line switch circuit 120 of the scan line N−1 stops supplying the scan conduction voltage Vdd to the scan line N−1, the parasitic capacitance Cr in the scan line switch circuit 120 corresponding to the scan line N−1 still has residual charges. Thus, when the scan operation signal controls the scan line switch circuit 120 of the scan line N to supply the scan conduction voltage Vdd to the scan line N and the data operation signal DOS controls the data line buffer circuit 130 of the data line Ch3 to supply the predetermined dimming level DIM to the data line Ch3, the charges in the parasitic capacitance Cr in the scan line switch circuit 120 of the scan line N−1 are released through the path indicated by the arrow in the figure, to light up the LED device at the scan line N−1 and the data line Ch3. For the same reason, other LED devices above the LED devices in the diagonal line are also turned ON during the scanning sequence. Therefore, the upper ghost image indicated by the dashed-line circle in FIG. 1B is generated.

Please refer to FIG. 1D. During the above-mentioned test, if the LED devices (as shown by gray dots in FIG. 1D) below the LED devices in the diagonal line emits light slightly, it is referred to as the lower ghost image. The lower ghost image phenomenon results from a parasitic capacitance Cc in the data line buffer circuit 130.

More specifically, please refer to FIGS. 1C and 1D, during the above-mentioned test, the scan operation signals control the scan line switch circuits 120 to supply the scan conduction voltage Vdd to the scan line N−1, the scan line N, the scan line N+1 and the scan line N+2 in sequence while the data operation signals DOS control the data line buffer circuit 130 to provide the predetermined dimming level DIM to the corresponding data line Ch4, the data line Ch3, the data line Ch2 and the data line Ch1 in sequence, so as to light up the corresponding LED devices at the scan line N−1 and the data line Ch4, at the scan line N and the data line Ch3, at the scan line N+1 and the data line Ch2, and at the scan line N+2 and the data line Ch1 in order.

For instance, after the LED device A stops being lit up and the data line buffer circuit 130 of the data line Ch3 stops supplying the predetermined dimming level DIM to the data line Ch3, the parasitic capacitance Cc in the data line buffer circuit 130 corresponding to the data line Ch3 still has residual charges. Thus, when the data line buffer circuit 130 of the data line Ch2 supplies the predetermined dimming level DIM to the data line Ch2 and the scan line switch circuit 120 of the scan line N+1 supplies the scan conduction voltage Vdd to the scan line N+1, a current path (indicated by the arrow in FIG. 1C) from the scan line switch circuit 120 of the scan line N+1 through the LED device at the data line Ch3 to the parasitic capacitance Cc in the data line buffer circuit 130 of the data line Ch3 is formed, which is enough to turn ON the LED device at the scan line N+1 and the data line Ch3 during the charge process, and turn ON other LED devices below the LED devices below the diagonal line for the same reason. Therefore, the lower ghost image indicated by the dashed-line circle as shown in FIG. 1D is generated.

In view of the drawbacks in the prior art, the present invention proposes a light emitting device array circuit capable of reducing ghost image and a driver circuit and a control method thereof.

SUMMARY OF THE INVENTION

In one aspect, the present invention provides a light emitting device array circuit capable of reducing ghost image, the light emitting device array circuit including: a light emitting device array including a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; a plurality of scan line switch circuits respectively and correspondingly coupled to the plurality of scan nodes, wherein in a frame, the plurality of scan line switch circuits respectively electrically connect the corresponding scan nodes to a scan conduction voltage in a non-overlapping sequential order; and a driver circuit including: a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-discharge control circuit coupled to the plurality of scan nodes and configured to operably provide a pre-discharge level to at least one predetermined scan node of the plurality of scan nodes during a predetermined pre-discharge time period according to a pre-discharge signal; wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node; wherein the predetermined pre-discharge time period is correlated with the dead time.

In another aspect, the present invention provides a light emitting device array circuit capable of reducing ghost image, the light emitting device array circuit including: a light emitting device array including a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; a plurality of scan line switch circuits respectively and correspondingly coupled to the plurality of scan nodes, wherein in a frame, the plurality of scan line switch circuits respectively electrically connect the corresponding scan nodes to a scan conduction voltage in a non-overlapping sequential order; and a driver circuit including: a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-charge control amplifier circuit coupled to the plurality of data nodes and configured to operably provide a pre-charge level to at least one predetermined data node of the plurality of data nodes during a predetermined pre-charge time period according to a pre-charge signal; wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node; wherein the predetermined pre-charge time period is correlated with the dead time.

In another aspect, the present invention provides a driver circuit of a light emitting device array circuit capable of reducing ghost image, wherein the driver circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; wherein the plurality of scan nodes are correspondingly coupled to a plurality of scan line switch circuits, wherein in a frame, the plurality of scan line switch circuits respectively electrically connect the corresponding scan nodes to a scan conduction voltage in a non-overlapping sequential order; the driver circuit comprising: a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-discharge control circuit coupled to the plurality of scan nodes and configured to operably provide a pre-discharge level to at least one predetermined scan node of the plurality of scan nodes during a predetermined pre-discharge time period according to a pre-discharge signal; wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node; wherein the predetermined pre-discharge time period is correlated with the dead time.

In another aspect, the present invention provides a driver circuit of a light emitting device array circuit, wherein the driver circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; wherein the plurality of scan nodes are correspondingly coupled to a plurality of scan line switch circuits, wherein in a frame, the plurality of scan line switch circuits respectively electrically connect the corresponding scan nodes to a scan conduction voltage in a non-overlapping sequential order; the driver circuit comprising: a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-charge control amplifier circuit coupled to the plurality of data nodes and configured to operably provide a pre-charge level to at least one predetermined data node of the plurality of data nodes during a predetermined pre-charge time period according to a pre-charge signal; wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node; wherein the predetermined pre-charge time period is correlated with the dead time.

In one preferred embodiment, in a normal pre-discharge mode, there are a plurality of predetermined pre-discharge time periods and a plurality of dead times in one frame, and wherein the pre-discharge control circuit employs the plurality of dead times in the frame as the plurality of predetermined pre-discharge time periods and provides the pre-discharge level to all of the scan nodes during the plurality of predetermined pre-discharge time periods according to the pre-discharge signal In one preferred embodiment, the driver circuit further includes: a pixel data storage circuit configured to operably store a pixel data storage signal, wherein the pixel data storage signal is configured to operably indicate a timing arrangement for lighting up the plurality of light emitting devices; and an Eco pre-discharge adjustment circuit coupled to the pixel data storage circuit and configured to operably employ the dead time before lighting up the predetermined light emitting device in the frame as the predetermined pre-discharge time period according to the pixel data storage signal in an Eco pre-discharge mode, and configured to control a plurality of pre-discharge switches during the predetermined pre-discharge time period to electrically connect the scan node of the scan line corresponding to the light emitting device which has been lit up just before the predetermined light emitting device to the pre-discharge level provided by the pre-discharge control circuit; wherein the plurality of pre-discharge switches are coupled to the plurality of scan nodes correspondingly.

In one preferred embodiment, in a first performance pre-discharge mode, the pre-discharge control circuit employs each dead time in the frame plus a performance time immediately before each dead time in the frame as the predetermined pre-discharge time period and provides the pre-discharge level to all of the scan nodes during the predetermined pre-discharge time period according to the pre-discharge signal.

In one preferred embodiment, the driver circuit further includes: a pixel data storage circuit configured to operably store a pixel data storage signal, wherein the pixel data storage signal is configured to operably indicate a timing arrangement for lighting up the plurality of light emitting devices; and an Eco pre-discharge adjustment circuit coupled to the pixel data storage circuit and configured to operably employ the dead time before lighting up the predetermined light emitting device plus a performance time immediately before the dead time in the frame as the predetermined pre-discharge time period according to the pixel data storage signal in a second Eco pre-discharge mode, and configured to control a plurality of pre-discharge switches during the predetermined pre-discharge time period to electrically connect the scan node of the scan line corresponding to the light emitting device which has been lit up just before the predetermined light emitting device to the pre-discharge level provided by the pre-discharge control circuit; wherein the plurality of pre-discharge switches are coupled to the plurality of scan nodes correspondingly.

In one preferred embodiment, the driver circuit further includes a pre-charge control amplifier circuit coupled to the plurality of data nodes and configured to operably provide a pre-charge level to at least one predetermined data node of the plurality of data nodes during a predetermined pre-charge time period according to a pre-charge signal; wherein the predetermined pre-charge time period is correlated with the dead time.

In one preferred embodiment, in a normal pre-charge mode, there are a plurality of predetermined pre-charge time periods and a plurality of dead times in one frame, and wherein the pre-charge control amplifier circuit employs the plurality of dead times in the frame as the plurality of predetermined pre-charge time periods and provides the pre-charge level to all of the data nodes during the plurality of predetermined pre-charge time periods according to the pre-charge signal.

In one preferred embodiment, the driver circuit further includes: a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device in the frame as the predetermined pre-charge time period according to the pixel data storage signal in an Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit; wherein the plurality of pre-charge switches are coupled to the plurality of data nodes correspondingly.

In one preferred embodiment, in a first performance pre-charge mode, the pre-charge control amplifier circuit employs each dead time in the frame plus a performance time immediately before each dead time in the frame as the predetermined pre-charge time period according to the pre-charge signal, and provides the pre-charge level to all of the data nodes during the predetermined pre-charge time period.

In one preferred embodiment, the driver circuit further includes: a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device plus a performance time immediately before the dead time in the frame as the predetermined pre-charge time period according to the pixel data storage signal in a second Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit; wherein the plurality of pre-charge switches are coupled to the plurality of data nodes correspondingly.

In one preferred embodiment, the driver circuit further includes a pre-discharge charge sharing control circuit, and in a pre-discharge charge sharing mode, the pre-discharge charge sharing control circuit is configured to operably control a plurality of pre-discharge switches to electrically connect the scan node of the scan line corresponding to the light emitting device which has been lit up just before the predetermined light emitting device to the scan node of the scan line corresponding to the predetermined light emitting device during a forepart time of the dead time before lighting up the predetermined light emitting device in the frame so as to achieve charge sharing between the two scan nodes; wherein the plurality of pre-discharge switches are coupled to the plurality of scan nodes correspondingly; wherein the scan node of the scan line corresponding to the light emitting device which has been lit up just before the predetermined light emitting device is addressed by a pixel data storage circuit of the driver circuit.

In one preferred embodiment, the driver circuit further includes a pre-charge charge sharing control circuit, and in a pre-charge charge sharing mode, the pre-charge charge sharing control circuit is configured to operably control a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame, so as to achieve charge sharing between the two data nodes; wherein the plurality of pre-charge switches are coupled to the plurality of data nodes correspondingly; wherein the data node of the data line corresponding to the light emitting device which has been lit up just before the predetermined light emitting device is addressed by a pixel data storage circuit of the driver circuit.

In another aspect, the present invention provides a control method of a light emitting device array circuit capable of reducing ghost image, wherein the light emitting device array circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; the control method comprising: in a frame, electrically connecting the plurality of scan nodes to a scan conduction voltage in a non-overlapping sequential order; when the scan nodes are electrically connected to the scan conduction voltage, providing predetermined dimming levels to predetermined ones of the data nodes respectively according to data operation signals, so as to light up the light emitting devices corresponding to the data nodes correspond and determine corresponding luminance; providing a pre-discharge level to at least one predetermined scan node of the plurality of scan nodes during a predetermined pre-discharge time period according to a pre-discharge signal; wherein there is a dead time between a time point at which providing the predetermined dimming level to one of the data nodes is changed to not providing the predetermined dimming level to said one of the data nodes and a time point at which not providing the predetermined dimming level to another one of the data nodes which corresponds to the light emitting device to be lit up in a next scan line is changed to providing the predetermined dimming level to said another one of the data nodes; wherein the predetermined pre-discharge time period is correlated with the dead time.

In one preferred embodiment, in a normal pre-discharge mode, there are a plurality of predetermined pre-discharge time periods and a plurality of dead times in one frame, and wherein the step of providing a pre-discharge level to at least one predetermined scan node of the plurality of scan nodes during a predetermined pre-discharge time period according to a pre-discharge signal includes: employing the plurality of dead times in the frame as the plurality of predetermined pre-discharge time periods according to the pre-discharge signal, and providing the pre-discharge level to all of the scan nodes during the plurality of predetermined pre-discharge time periods.

In one preferred embodiment, the step of providing a pre-discharge level to at least one predetermined scan node of the plurality of scan nodes during a predetermined pre-discharge time period according to a pre-discharge signal includes: employing the dead time before lighting up the predetermined light emitting device in the frame as the predetermined pre-discharge time period according to a pixel data storage signal in an Eco pre-discharge mode; and controlling a plurality of pre-discharge switches during the predetermined pre-discharge time period to electrically connect the scan node of the scan line corresponding to the light emitting device which has been lit up just before the predetermined light emitting device to the pre-discharge level; wherein the pixel data storage signal is configured to operably indicate a timing arrangement for lighting up the plurality of light emitting devices; wherein the plurality of pre-discharge switches are coupled to the plurality of scan nodes correspondingly.

In one preferred embodiment, the step of providing a pre-discharge level to at least one predetermined scan node of the plurality of scan nodes during a predetermined pre-discharge time period according to a pre-discharge signal includes: employing each dead time in the frame plus a performance time immediately before each dead time in the frame as the predetermined pre-discharge time period according to the pre-discharge signal in a first performance pre-discharge mode and providing the pre-discharge level to all of the scan nodes during the predetermined pre-discharge time period.

In one preferred embodiment, the step of providing a pre-discharge level to at least one predetermined scan node of the plurality of scan nodes during a predetermined pre-discharge time period according to a pre-discharge signal includes: in a second Eco pre-discharge mode, employing the dead time before lighting up the predetermined light emitting device plus a performance time immediately before the dead time in the frame as the predetermined pre-discharge time period according to a pixel data storage signal; and controlling a plurality of pre-discharge switches during the predetermined pre-discharge time period to electrically connect the scan node of the scan line corresponding to the light emitting device which has been lit up just before the predetermined light emitting device to the pre-discharge level; wherein the pixel data storage signal is configured to operably indicate a timing arrangement for lighting up the plurality of light emitting devices; wherein the plurality of pre-discharge switches are coupled to the plurality of scan nodes correspondingly.

In one preferred embodiment, the control method further includes: providing a pre-charge level to at least one predetermined data node of the plurality of data nodes during a predetermined pre-charge time period according to a pre-charge signal; wherein the predetermined pre-charge time period is correlated with the dead time.

In one preferred embodiment, in a normal pre-charge mode, there are a plurality of predetermined pre-charge time periods and a plurality of dead times in one frame, and wherein the step of providing a pre-charge level to at least one predetermined data node of the plurality of data nodes during a predetermined pre-charge time period according to a pre-charge signal includes: employing the plurality of dead times in the frame as the plurality of predetermined pre-charge time periods according to the pre-charge signal in a normal pre-charge mode and providing the pre-charge level to all of the data nodes during the plurality of predetermined pre-charge time periods.

In one preferred embodiment, the step of providing a pre-charge level to at least one predetermined data node of the plurality of data nodes during a predetermined pre-charge time period according to a pre-charge signal includes: employing the dead time before lighting up the predetermined light emitting device in the frame as the predetermined pre-charge time period according to a pixel data storage signal in an Eco pre-charge mode; and controlling a plurality of pre-charge switches during the predetermined pre-charge time period to electrically connect the data node of the data line corresponding to the light emitting device which has been lit up just before the predetermined light emitting device to the pre-charge level; wherein the pixel data storage signal is configured to operably indicate a timing arrangement for lighting up the plurality of light emitting devices; wherein the plurality of pre-charge switches are coupled to the plurality of data nodes correspondingly.

In one preferred embodiment, the step of providing a pre-charge level to at least one predetermined data node of the plurality of data nodes during a predetermined pre-charge time period according to a pre-charge signal includes: in a first performance pre-charge mode, employing each dead time in the frame plus a performance time immediately before each dead time in the frame as the predetermined pre-charge time period according to the pre-charge signal, and providing the pre-charge level to all of the data nodes during the predetermined pre-charge time period.

In one preferred embodiment, the step of providing a pre-charge level to at least one predetermined data node of the plurality of data nodes during a predetermined pre-charge time period according to a pre-charge signal includes: in a second Eco pre-charge mode, employing the dead time before lighting up the predetermined light emitting device plus a performance time immediately before the dead time in the frame as the predetermined pre-charge time period according to a pixel data storage signal; and controlling a plurality of pre-charge switches during the predetermined pre-charge time period to electrically connect the data node of the data line corresponding to the light emitting device which has been lit up just before the predetermined light emitting device to the pre-charge level; wherein the pixel data storage signal is configured to operably indicate a timing arrangement for lighting up the plurality of light emitting devices; wherein the plurality of pre-charge switches are coupled to the plurality of data nodes correspondingly.

In one preferred embodiment, the control method further includes: in a pre-discharge charge sharing mode, controlling a plurality of pre-discharge switches to electrically connect the scan node of the scan line corresponding to the light emitting device which has been lit up just before the predetermined light emitting device to the scan node of the scan line corresponding to the predetermined light emitting device during a forepart time of the dead time before lighting up the predetermined light emitting device in the frame so as to achieve charge sharing between the two scan nodes; wherein the plurality of pre-discharge switches are coupled to the plurality of scan nodes correspondingly; wherein the scan node of the scan line corresponding to the light emitting device which has been lit up just before the predetermined light emitting device is addressed by a pixel data storage signal.

In one preferred embodiment, the control method further includes: in a pre-charge charge sharing mode, controlling a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame so as to achieve charge sharing between the two data nodes; wherein the plurality of pre-charge switches are coupled to the plurality of data nodes correspondingly; wherein the data node of the data line corresponding to the light emitting device which has been lit up just before the predetermined light emitting device is addressed by a pixel data storage signal.

In another aspect, the present invention provides a control method of a light emitting device array circuit capable of reducing ghost image, wherein the light emitting device array circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; the control method comprising: in a frame, electrically connecting the plurality of scan nodes to a scan conduction voltage in a non-overlapping sequential order; when the scan nodes are electrically connected to the scan conduction voltage, providing predetermined dimming levels to the predetermined data nodes respectively according to data operation signals, so as to light up the light emitting devices corresponding to the data nodes and determine corresponding luminance; providing a pre-charge level to at least one predetermined data node of the plurality of data nodes during a predetermined pre-charge time period according to a pre-charge signal; wherein there is a dead time between a time point at which providing the predetermined dimming level to one of the data nodes is changed to not providing the predetermined dimming level to said one of the data nodes and a time point at which not providing the predetermined dimming level to another one of the data nodes which corresponds to the light emitting device to be lit up in a next scan line is changed to providing the predetermined dimming level to said another one of the data nodes; wherein the predetermined pre-charge time period is correlated with the dead time.

Advantages of the present invention include: that the present invention can reduce lower ghost image via the pre-charge operation and can reduce upper ghost image via the pre-discharge operation, and that the pre-charge and pre-discharge operations of the present invention include an Eco mode, a first performance mode and a second performance mode to reduce power consumption while still being able to solve the upper ghost image and the lower ghost image problems.

The objectives, technical details, features, and effects of the present invention will be better understood with regard to the detailed description of the embodiments below.

DESCRIPTION OF THE PREFERRED EMBODIMENTS

The above and other technical details, features, and effects of the present invention will be clearly presented in the detailed description of the embodiments below, with reference to the attached drawings. The drawings as referred to throughout the description of the present invention are for illustration only, to show the interrelations between the circuits and the signal waveforms, but not drawn according to actual scale of circuit sizes and signal amplitudes and frequencies.

Figure 1A:
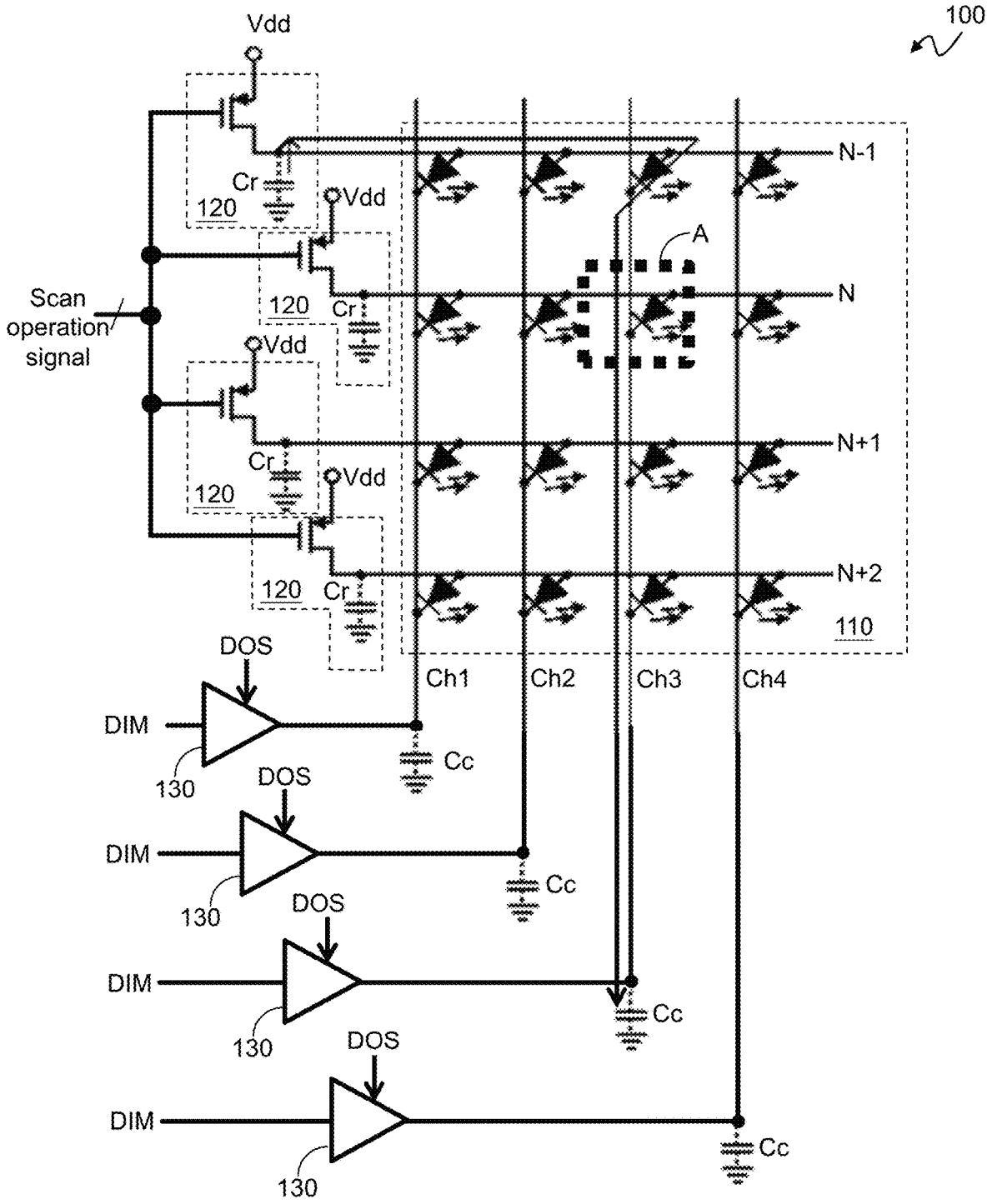
Fig. 1A (Prior Art)
FIG. 1A illustrates a schematic diagram of a conventional light emitting diode array circuit.
Figure 1B:
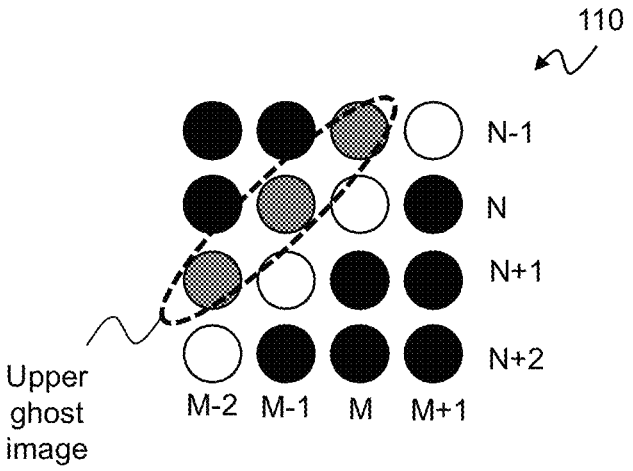
Fig. 1B (Prior Art)
FIG. 1B illustrates an upper ghost image phenomenon of the conventional LED array.
Figure 1D:
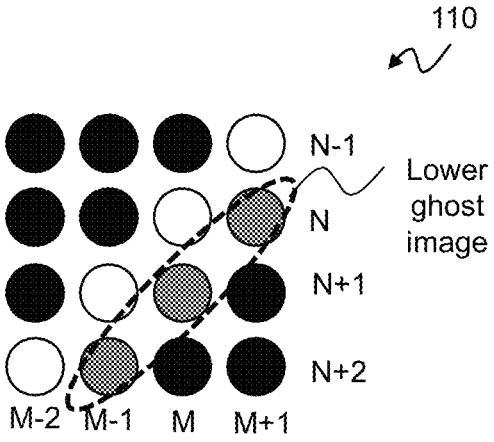
Fig. 1D (Prior Art)
FIGS. 1C and 1D illustrate a lower ghost image phenomenon of the conventional LED array.
Figure 1C:
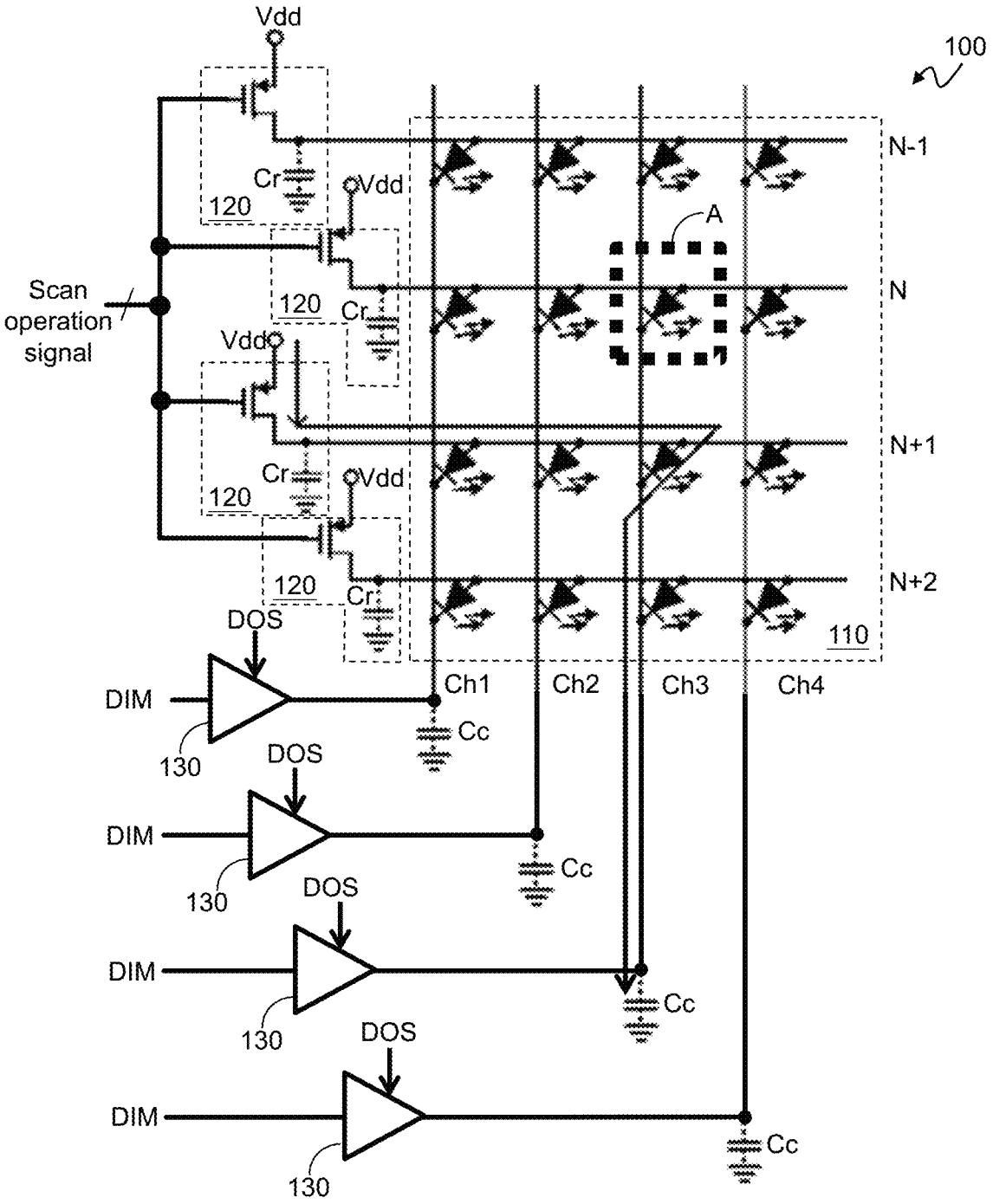
Fig. 1C (Prior Art)
Figure 2:
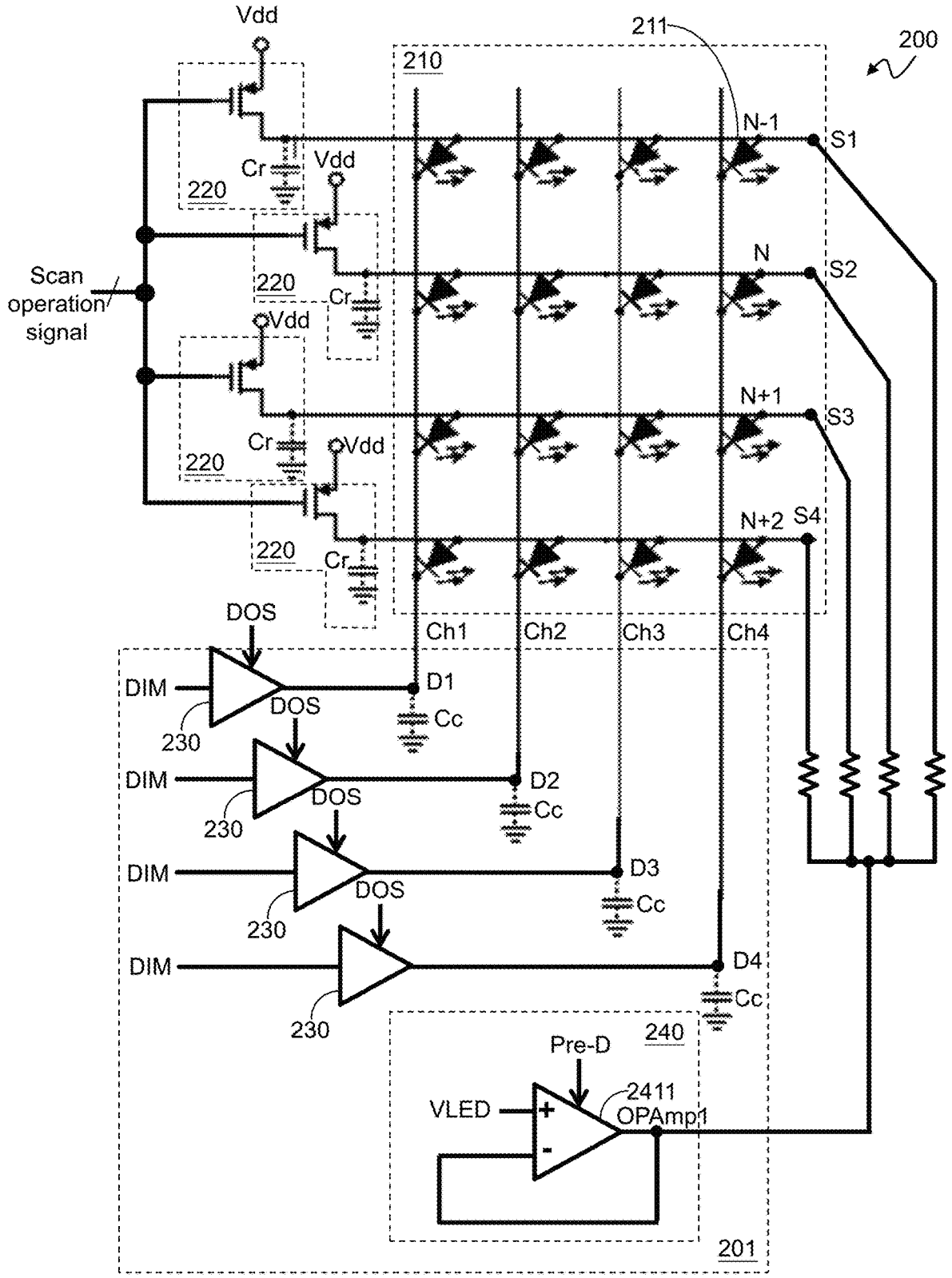
FIG. 2 illustrates a schematic diagram of a light emitting device array circuit in accordance with one embodiment of the present invention.

FIG. 2 illustrates a light emitting device array circuit 200 in accordance with one embodiment of the present invention. The light emitting device array circuit 200 includes a light emitting device array 210, plural scan line switch circuits 220 and a driver circuit 201. The light emitting device array 210 includes plural light emitting devices 211, for example but not limited to LED devices shown in the figure. The plural light emitting devices 211 are arranged in plural scan lines, for example but not limited to the scan lines N−1, N, N+1, N+2 shown in FIG. 2, and plural data lines, for example but not limited to the data lines Ch1, Ch2, Ch3, Ch4 shown in FIG. 2. The numbers of the scan lines and the data lines are shown to be both four in this embodiment, which is only for illustration but not for limiting the broadest scope of the present invention. According to the present invention, the scan lines and the data lines can be other numbers, and the numbers of the scan lines and the data lines can be different from each other, in other embodiments.

Forward ends of the plural light emitting devices 211 in each scan line N−1, N, N+1 or N+2 are commonly coupled to a same scan node S1, S2, S3 or S4. For example, as shown in FIG. 2, the forward ends of the plural light emitting devices 211 in the scan line N−1 are commonly coupled to the scan node S1; the forward ends of the plural light emitting devices 211 in the scan line N are commonly coupled to the scan node S2; the forward ends of the plural light emitting devices 211 in the scan line N+1 are commonly coupled to the scan node S3; the forward ends of the plural light emitting devices 211 in the scan line N+2 are commonly coupled to the scan node S4. Reverse ends of the plural light emitting devices 211 in each data line Ch1, Ch2, Ch3 or Ch4 are commonly coupled to a same data node D1, D2, D3, D4. For instance, as shown in FIG. 2, the reverse ends of the plural light emitting devices 211 in the data line Ch1 are commonly coupled to the data node D1; the reverse ends of the plural light emitting devices 211 in the data line Ch2 are commonly coupled to the data node D2; the reverse ends of the plural light emitting devices 211 in the data line Ch3 are commonly coupled to the data node D3; the reverse ends of the plural light emitting devices 211 in the data line Ch4 are commonly coupled to the data node D4.

As shown in FIG. 2, plural scan line switch circuits 220 are respectively and correspondingly coupled to the plural scan nodes S1, S2, S3, S4. In a frame, the plural scan line switch circuits 220 respectively electrically connect the corresponding scan nodes S1, S2, S3, S4 to a scan conduction voltage Vdd in a non-overlapping sequential order, for example according to the listing order of the plural scan lines S1, S2, S3, S4. Note that the arrangement sequence of the plural scan lines S1, S2, S3, S4 is not limited to the arrangement sequence from the upper to the lower, and therefore can be the arrangement sequence from the lower to the upper alternatively, or can be the nonadjacent sequence alternatively as long as all of the scan nodes S1, S2, S3, S4 in the light emitting device array 210 are respectively electrically connected to the scan conduction voltage Vdd in a non-overlapping sequential order in one frame.

Still referring to FIG. 2, the driver circuit 201 includes plural data line buffer circuits 230 and a pre-discharge control circuit 240. The plural data line buffer circuits 230 are respectively and correspondingly coupled to the plural data nodes D1, D2, D3, D4. Each data line buffer circuit 230 provides or does not provide a predetermined dimming level DIM to the corresponding data node D1, D2, D3 or D4 according to a data operation signal DOS.

Please still refer to FIG. 2. The pre-discharge control circuit 240 is coupled to the plural scan nodes S1, S2, S3, S4 and is configured to operably provide a pre-discharge level VLED to at least one predetermined scan node S1, S2, S3 and/or S4 during a predetermined pre-discharge time period according to a pre-discharge signal Pre-D. For example, as shown in FIG. 2, an error amplifier 2411 is enabled by the pre-discharge signal Pre-D during the predetermined pre-discharge time period to provide the pre-discharge level VLED to at least one predetermined scan node S1, S2, S3 and/or S4. As shown in the figure, there can be a resistor, or a switch or other electronic devices coupled between the error amplifier 2411 and the scan nodes S1, S2, S3, S4, and in such case the voltage at the scan node S1, S2, S3 or S4 is not precisely equal to the pre-discharge level VLED, this still belongs to the scope of the present invention because the voltage at the scan node S1, S2, S3 or S4 is still under control to be correlated with the pre-discharge level VLED.

There is a dead time between a time point at which the data line buffer circuit 230 changes from providing the predetermined dimming level DIM to the corresponding data node D1, D2, D3 or D4 to not providing the predetermined dimming level DIM to the corresponding data node D1, D2, D3 or D4 and a time point at which the data line buffer circuit 230 corresponding to the light emitting device 211 to be lit up in next scan line N−1, N, N+1 or N+2 changes from not providing the predetermined dimming level DIM to the corresponding data node D1, D2, D3 or D4 to providing the predetermined dimming level DIM to the corresponding data node D1, D2, D3 or D4. The predetermined pre-discharge time period is correlated with the dead time. For instance, the dead time is the predetermined pre-discharge time period; or, part of the dead time serves as the predetermined pre-discharge time period; or, a time period is just before or just after the dead time is combined with at least a part of the dead time to serve as the predetermined pre-discharge time period.

In one preferred embodiment, the pre-discharge level VLED is correlated with a difference between the scan conduction voltage Vdd and a predetermined voltage drop. For instance, the pre-discharge level VLED is, for example but not limited to, the scan conduction voltage Vdd minus a voltage of 1.2V, i.e., the predetermined voltage drop is for instance 1.2V; or the pre-discharge level VLED is, for example but not limited to, the scan conduction voltage Vdd minus a voltage of 4.5V, i.e., the predetermined voltage drop is for instance 4.5V; or in other embodiments, the predetermined voltage drop can be, for example but not limited to, a voltage between 1.2V and 4.5V.

Figure 3:
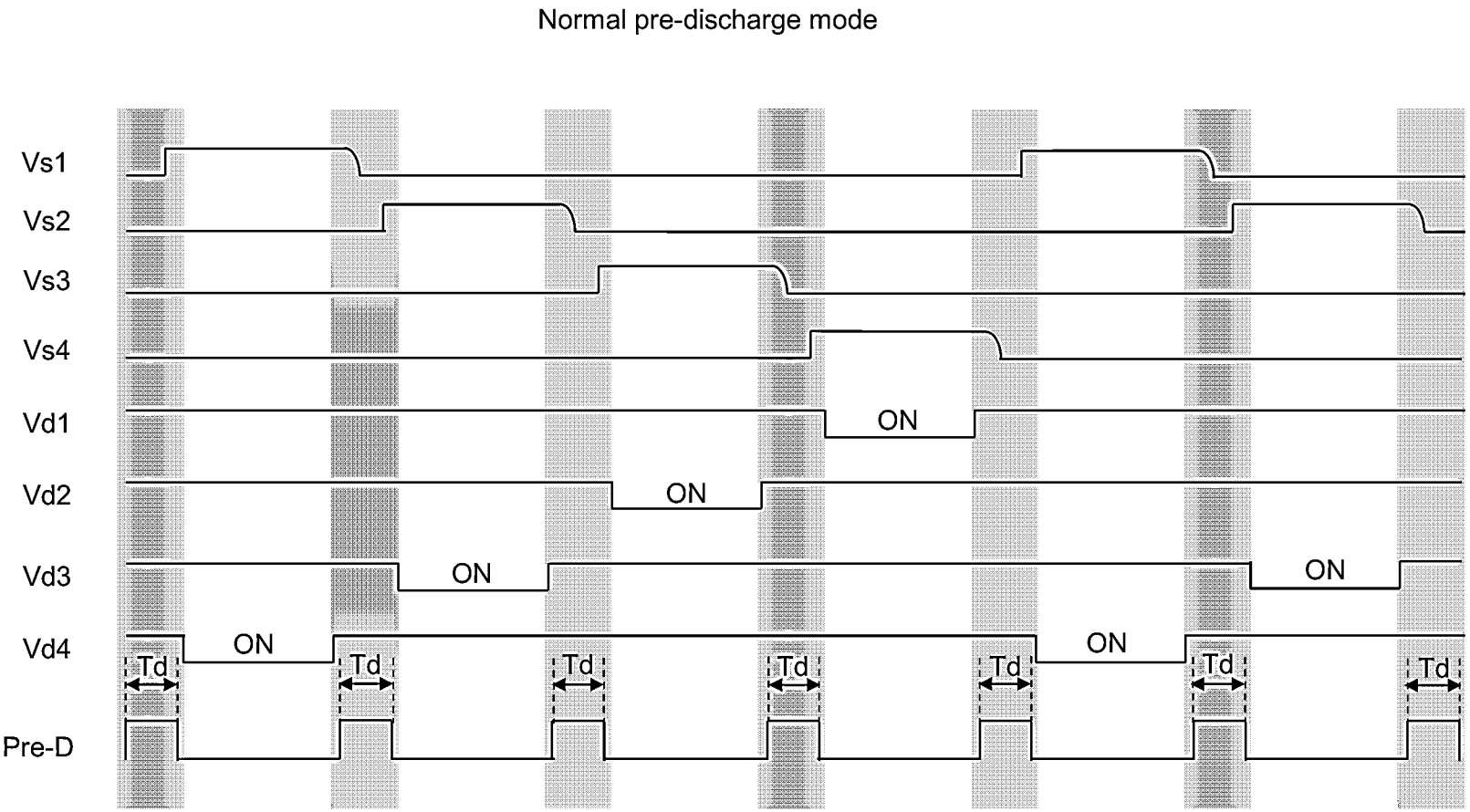
FIG. 3 illustrates a signal waveform diagram of the light emitting device array circuit under a normal pre-discharge mode in accordance with one embodiment of the present invention.

FIG. 3 illustrates a signal waveform diagram of the light emitting device array circuit under a normal pre-discharge mode in accordance with one embodiment of the present invention. The voltage Vs1 at the scan node Si (the scan node voltage Vs1), the voltage Vs2 at the scan node S2 (the scan node voltage Vs2), the voltage Vs3 at the scan node S3 (the scan node voltage Vs3), the voltage Vs4 at the scan node S4 (the scan node voltage Vs4), the voltage Vd1 at the data node D1 (the data node voltage Vd1), the voltage Vd2 at the data node D2 (the data node voltage Vd2), the voltage Vd3 at the data node D3 (the data node voltage Vd3), the voltage Vd4 at the data node D4 (the data node voltage Vd4), and the pre-discharge signal Pre-D are shown in FIG. 3. As shown in FIG. 3, also referring to FIG. 2, in a normal pre-discharge mode, the pre-discharge control circuit 240 for instance employs the plural dead times Td in the frame as the plural predetermined pre-discharge time periods according to the pre-discharge signal Pre-D and provides the pre-discharge level VLED to all of the scan nodes S1, S2, S3 and S4 during the plural predetermined pre-discharge time periods.

Figure 4:
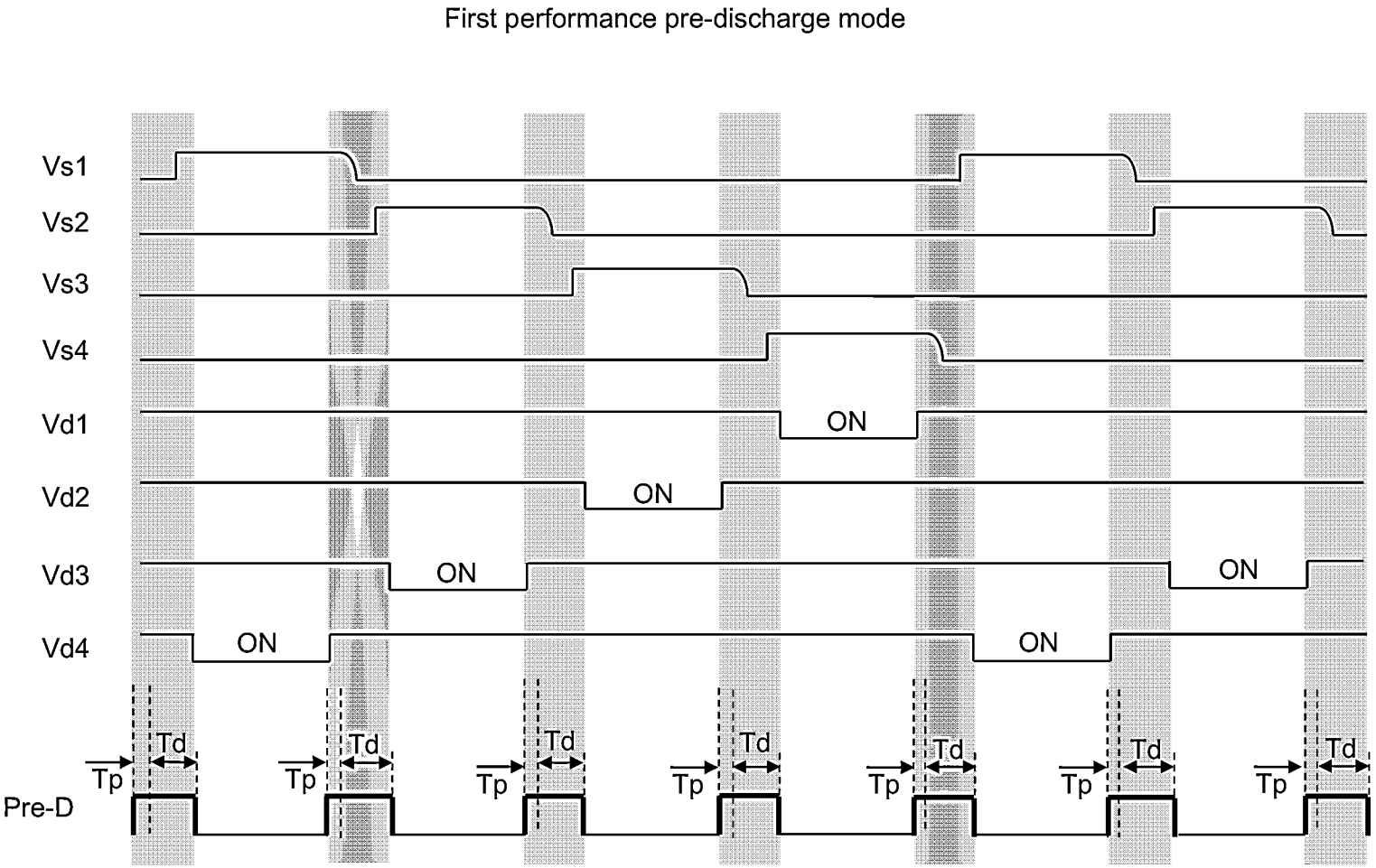
FIG. 4 illustrates a signal waveform diagram of the light emitting device array circuit under a first performance pre-discharge mode in accordance with one embodiment of the present invention.

FIG. 4 illustrates a signal waveform diagram of the light emitting device array circuit under a first performance pre-discharge mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4, and the pre-discharge signal Pre-D are shown in FIG. 4. As shown in FIG. 4, also referring to FIG. 2, in a first performance pre-discharge mode, the pre-discharge control circuit 240 for example employs each dead time Td in the frame plus a performance time Tp immediately before each dead time Td in the frame as the predetermined pre-discharge time period according to the pre-discharge signal Pre-D, and provides the pre-discharge level VLED to all of the scan nodes S1, S2, S3 and S4 during the predetermined pre-discharge time period.

Figure 5:
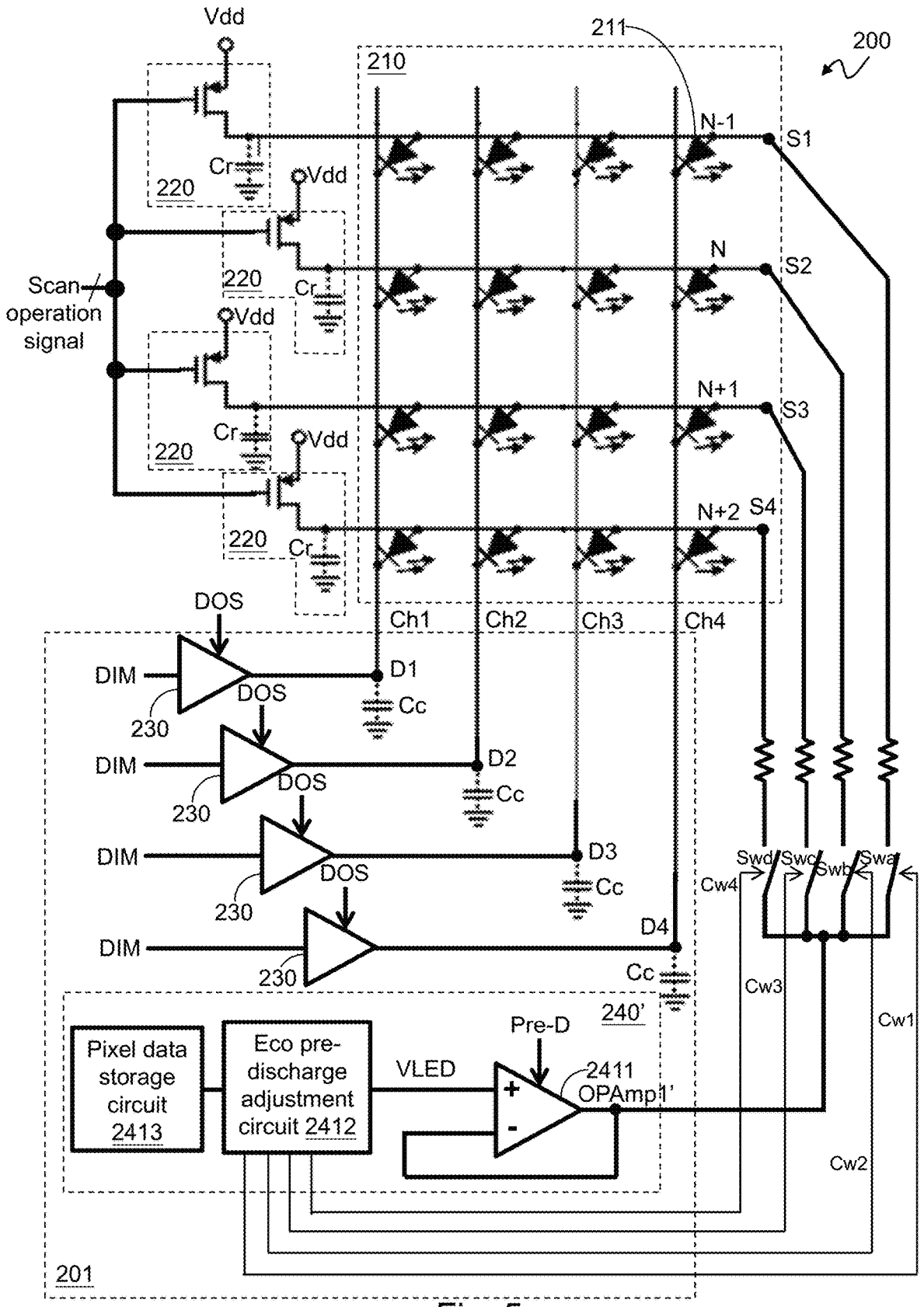
FIG. 5 illustrates a schematic diagram of a light emitting device array circuit in accordance with another embodiment of the present invention.

FIG. 5 illustrates a schematic diagram of a light emitting device array circuit in accordance with another embodiment of the present invention. The difference between this embodiment and the embodiment of FIG. 2 is that in this embodiment, there are resistors and pre-discharge switches Swa, Swb, Swc and Swd coupled between the error amplifier 2411 and the scan nodes S1, S2, S3, S4, and the pre-discharge control circuit 240' further includes an Eco pre-discharge adjustment circuit 2412 and a pixel data storage circuit 2413. The pixel data storage circuit 2413 is configured to operably store a pixel data storage signal which is configured to operably indicate a timing arrangement for lighting up the plural light emitting devices 211.

Figure 6:
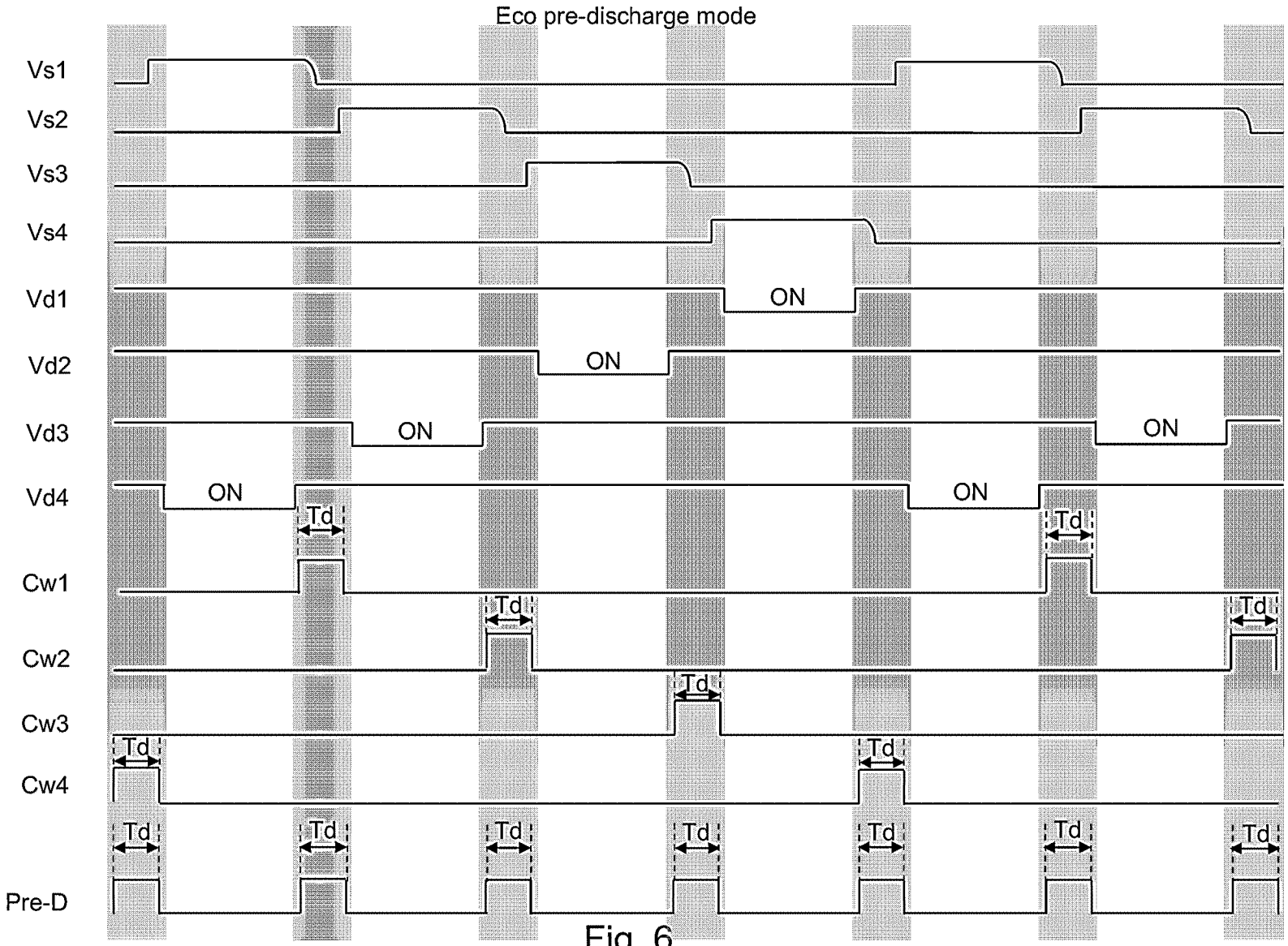
FIG. 6 illustrates a signal waveform diagram of the light emitting device array circuit under an Eco pre-discharge mode in accordance with one embodiment of the present invention.

FIG. 6 illustrates a signal waveform diagram of the light emitting device array circuit under an Eco pre-discharge mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4, the control signal Cw1 of the switch Swa, the control signal Cw2 of the switch Swb, the control signal Cw3 of the switch Swc, the control signal Cw4 of the switch Swd and the pre-discharge signal Pre-D are shown in FIG. 6. Please also refer to FIG. 5. In an Eco pre-discharge mode, the Eco pre-discharge adjustment circuit 2412 is coupled to the pixel data storage circuit 2413 and is configured to operably employ the dead time Td before lighting up the predetermined light emitting device 211 in the frame as the predetermined pre-discharge time period according to the pixel data storage signal, and configured to control plural pre-discharge switches Swa, Swb, Swc and Swd during the predetermined pre-discharge time period to electrically connect the scan node S1, S2, S3 or S4 of the scan line N−1, N, N+1 or N+2 corresponding to the light emitting device 211 which has been lit up just before the predetermined light emitting device 211 to the pre-discharge level VLED provided by the pre-discharge control circuit 240. In one embodiment, the plural pre-discharge switches Swa, Swb, Swc and Swd are coupled to the plural scan nodes S1, S2, S3 and S4 correspondingly.

Take the embodiment shown in FIG. 6 as an example. According to the present invention, when the light emitting device array circuit 200 operates in the Eco pre-discharge mode, and for example, when the predetermined light emitting device 211 is at the scan line N and the data line Ch3, and the light emitting device 211 which has been lit up just before the predetermined light emitting device 211 is at the scan line N−1 and the data line Ch4, the dead time Td before lighting up the predetermined light emitting device 211 (scan line N, data line Ch3) is employed as the predetermined pre-discharge time period, wherein in this predetermined pre-discharge time period, the pre-discharge switch Swa is turned ON while the pre-discharge switches Swb, Swc and Swd are turned OFF to electrically connect the scan node S1 of the scan line N−1 corresponding to the light emitting device 211 (scan line N−1, data line Ch4) which has been lit up just before the predetermined light emitting device 211 (scan line N, data line Ch3) to the pre-discharge level VLED provided by the pre-discharge control circuit 240, and so on.

Figure 7:
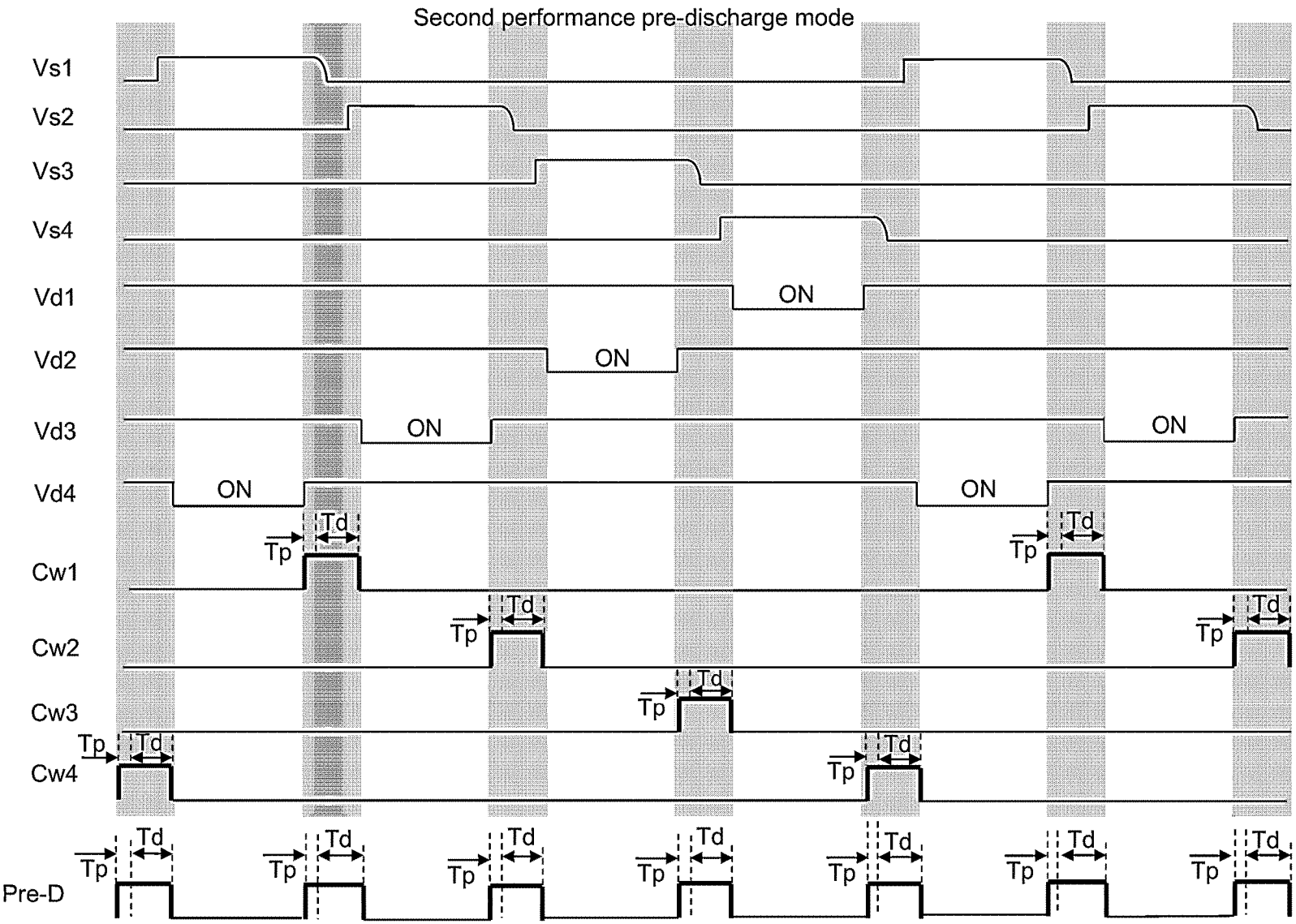
FIG. 7 illustrates a signal waveform diagram of the light emitting device array circuit under a second performance pre-discharge mode in accordance with one embodiment of the present invention.

FIG. 7 illustrates a signal waveform diagram of the light emitting device array circuit under a second performance pre-discharge mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4, the control signal Cw1 of the switch Swa, the control signal Cw2 of the switch Swb, the control signal Cw3 of the switch Swc, the control signal Cw4 of the switch Swd and the pre-discharge signal Pre-D are shown in FIG. 7. Please also refer to FIG. 5. The Eco pre-discharge adjustment circuit 2412 is coupled to the pixel data storage circuit 2413 and is configured to operably employ the dead time Td before lighting up the predetermined light emitting device 211 plus a performance time Tp immediately before the dead time Td in the frame as the predetermined pre-discharge time period (i.e., Td+Tp) according to the pixel data storage signal in a second Eco pre-discharge mode, and configured to control plural pre-discharge switches Swa, Swb, Swc and Swd during the predetermined pre-discharge time period to electrically connect the scan node S1, S2, S3 or S4 of the scan line N−1, N, N+1 or N+2 corresponding to the light emitting device 211 which has been lit up just before the predetermined light emitting device 211 to the pre-discharge level VLED provided by the pre-discharge control circuit 240.

Figure 8:
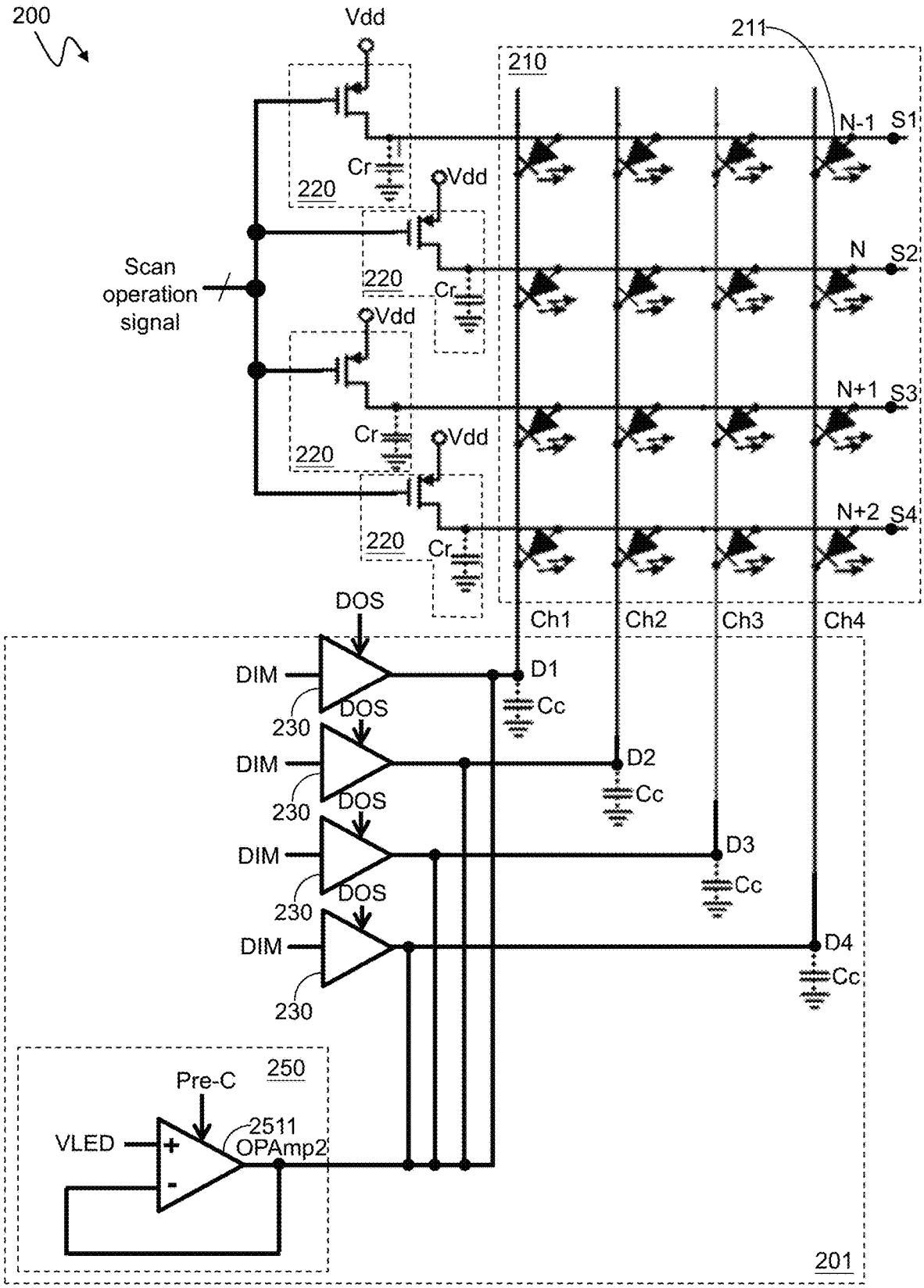
FIG. 8 illustrates a schematic diagram of a light emitting device array circuit in accordance with still another embodiment of the present invention.

FIG. 8 illustrates a schematic diagram of a light emitting device array circuit in accordance with still another embodiment of the present invention. The difference between this embodiment and the embodiment of FIG. 2 is that the driver circuit 201 of this embodiment includes plural data line buffer circuits 230 and further includes a pre-charge control amplifier circuit 250. The data line buffer circuits 230 are similar to the data line buffer circuits 230 in FIG. 2 and therefore the detailed descriptions thereof are omitted. The pre-charge control amplifier circuit 250 is coupled to the plural data nodes D1, D2, D3, D4 and is configured to operably provide a pre-charge level VLED to at least one predetermined data node D1, D2, D3 and/or D4 during a predetermined pre-charge time period according to a pre-charge signal Pre-C. For instance, as shown in FIG. 8, an error amplifier 2511 is enabled by the pre-charge signal Pre-C during the predetermined pre-charge time period to provide the pre-charge level VLED to at least one predetermined data node D1, D2, D3 and/or D4. In one embodiment, the predetermined pre-charge time period is correlated with the dead time.

Figure 9:
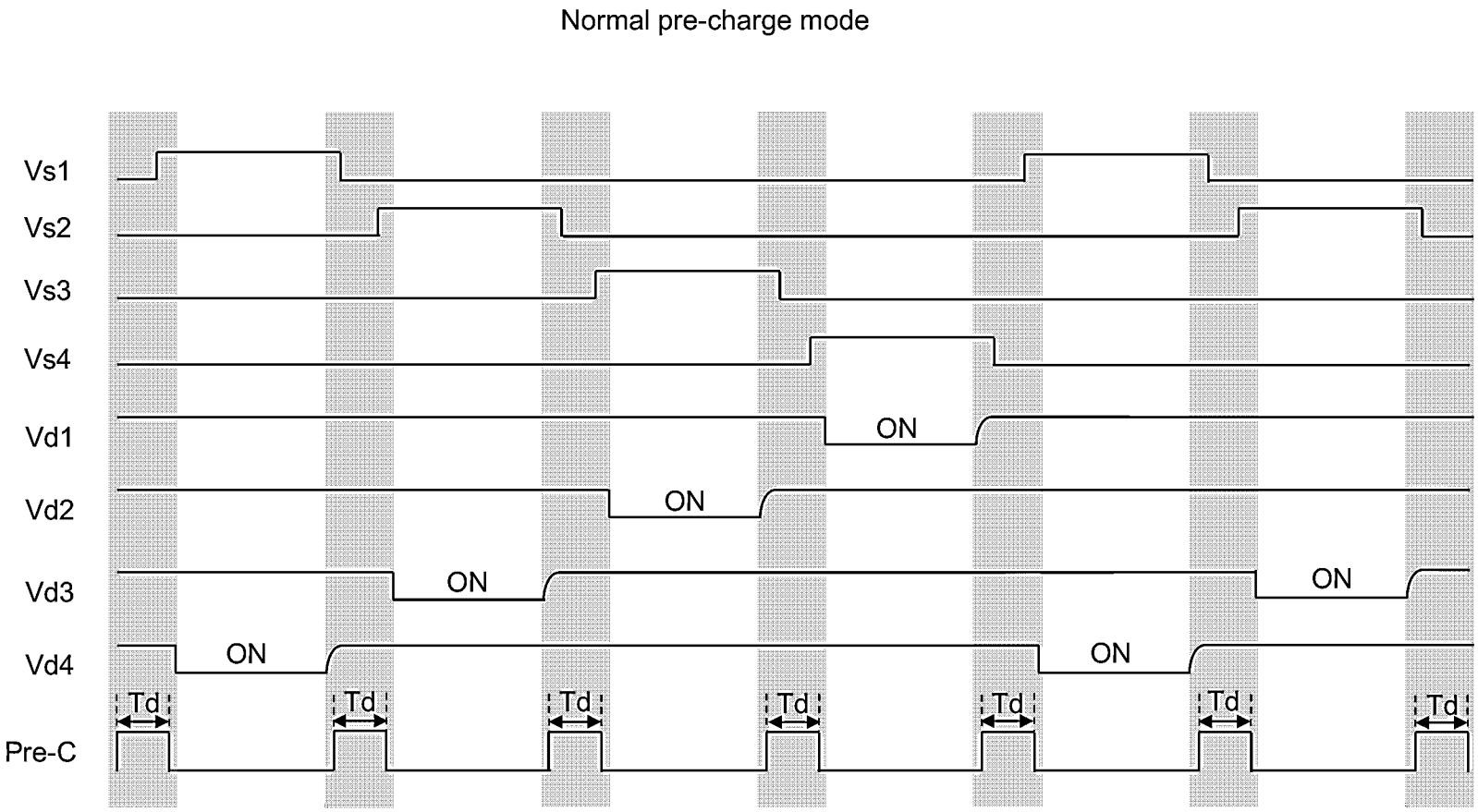
FIG. 9 illustrates a signal waveform diagram of the light emitting device array circuit under a normal pre-charge mode in accordance with one embodiment of the present invention.

FIG. 9 illustrates a signal waveform diagram of the light emitting device array circuit under a normal pre-charge mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4 and the pre-charge signal Pre-C are shown in FIG. 9. As shown in FIG. 9, also referring to FIG. 8, in a normal pre-charge mode, the pre-charge control amplifier circuit 250 employs the plural dead times Td in the frame as the plural predetermined pre-charge time periods according to the pre-charge signal Pre-C, and provides the pre-charge level VLED to all of the data nodes D1, D2, D3 and D4 during the plural predetermined pre-charge time periods.

Figure 10:
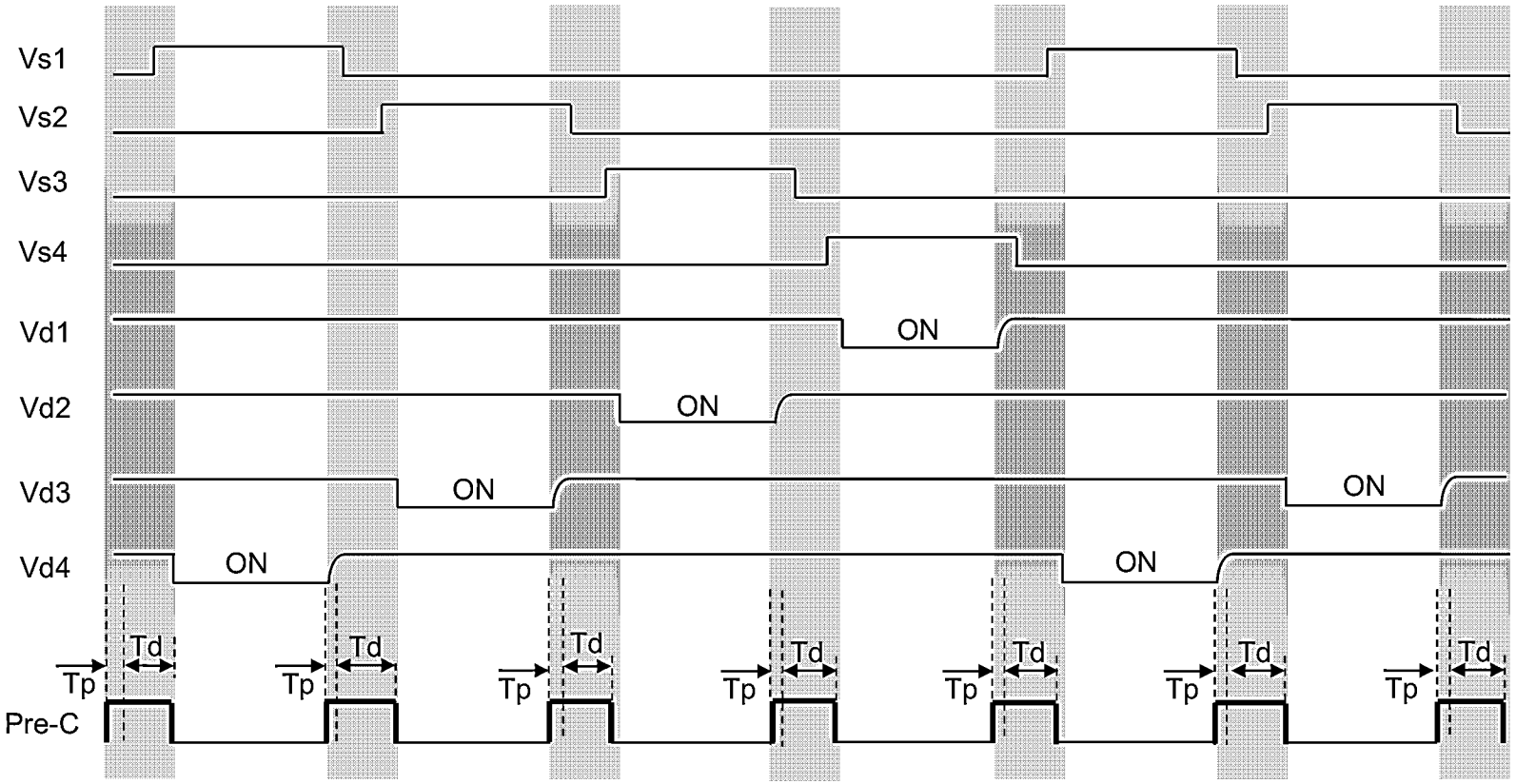
FIG. 10 illustrates a signal waveform diagram of the light emitting device array circuit under a first performance pre-charge mode in accordance with one embodiment of the present invention.

FIG. 10 illustrates a signal waveform diagram of the light emitting device array circuit under a first performance pre-charge mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4 and the pre-charge signal Pre-C are shown in FIG. 10. As shown in FIG. 10, in a first performance pre-charge mode, the pre-charge control amplifier circuit 250 employs each dead time Td in the frame plus a performance time Tp immediately before each dead time Td in the frame as the predetermined pre-charge time period according to the pre-charge signal Pre-C, and provides the pre-charge level VLED to all of the data nodes D1, D2, D3 and D4 during the predetermined pre-charge time period.

Figure 11:
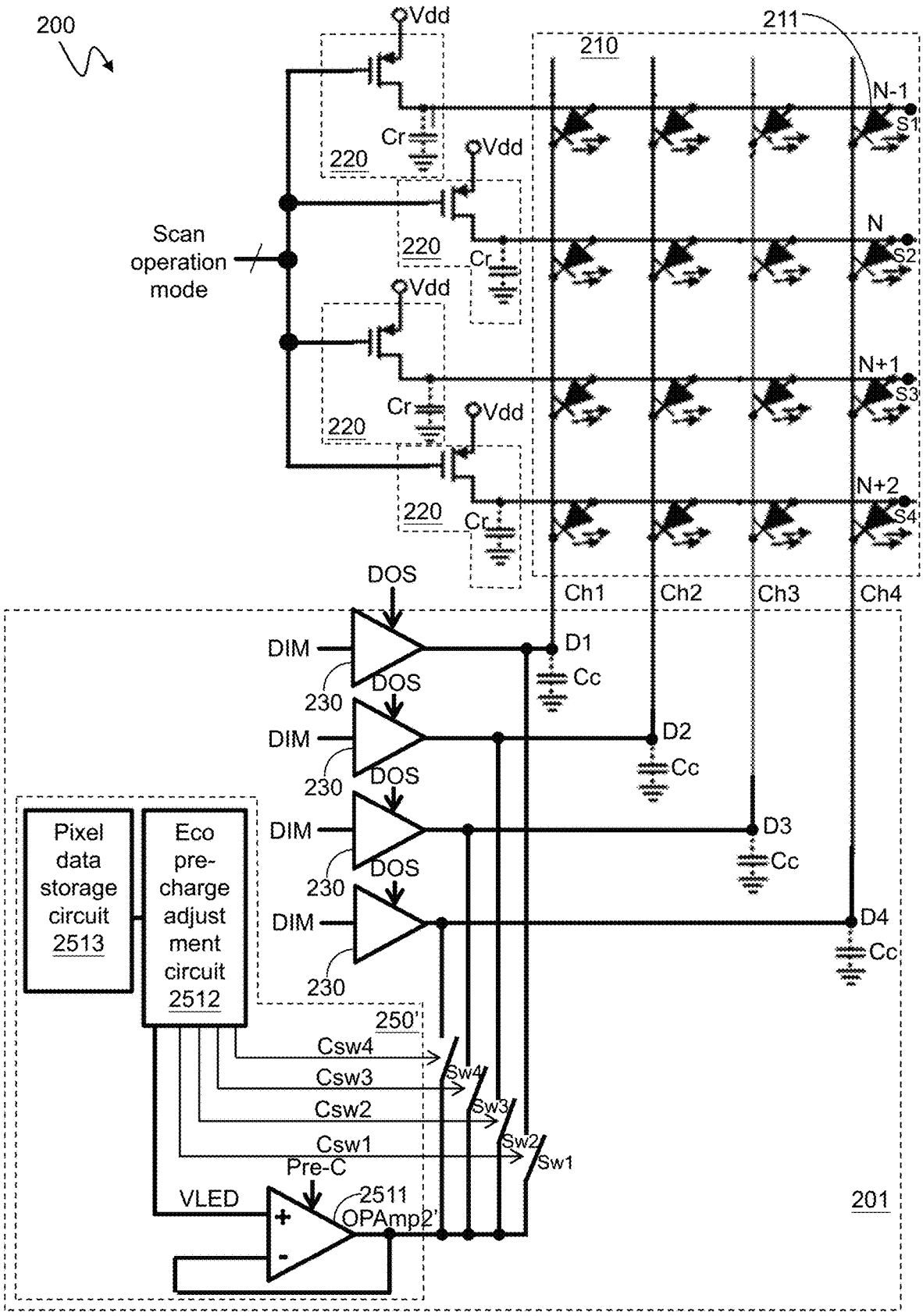
FIG. 11 illustrates a schematic diagram of a light emitting device array circuit in accordance with yet another embodiment of the present invention.

FIG. 11 illustrates a schematic diagram of a light emitting device array circuit in accordance with yet another embodiment of the present invention. The difference between this embodiment and the embodiment of FIG. 8 is that in this embodiment, there are pre-charge switches Sw1, Sw2, Sw3 and Sw4 coupled between the error amplifier 2511 and the data nodes D1, D2, D3, D4, and the pre-charge control amplifier circuit 250 further includes an Eco pre-charge adjustment circuit 2512 and a pixel data storage circuit 2513. The pixel data storage circuit 2513 is configured to operably store a pixel data storage signal which is configured to operably indicate a timing arrangement for lighting up the plural light emitting devices 211.

Figure 12:
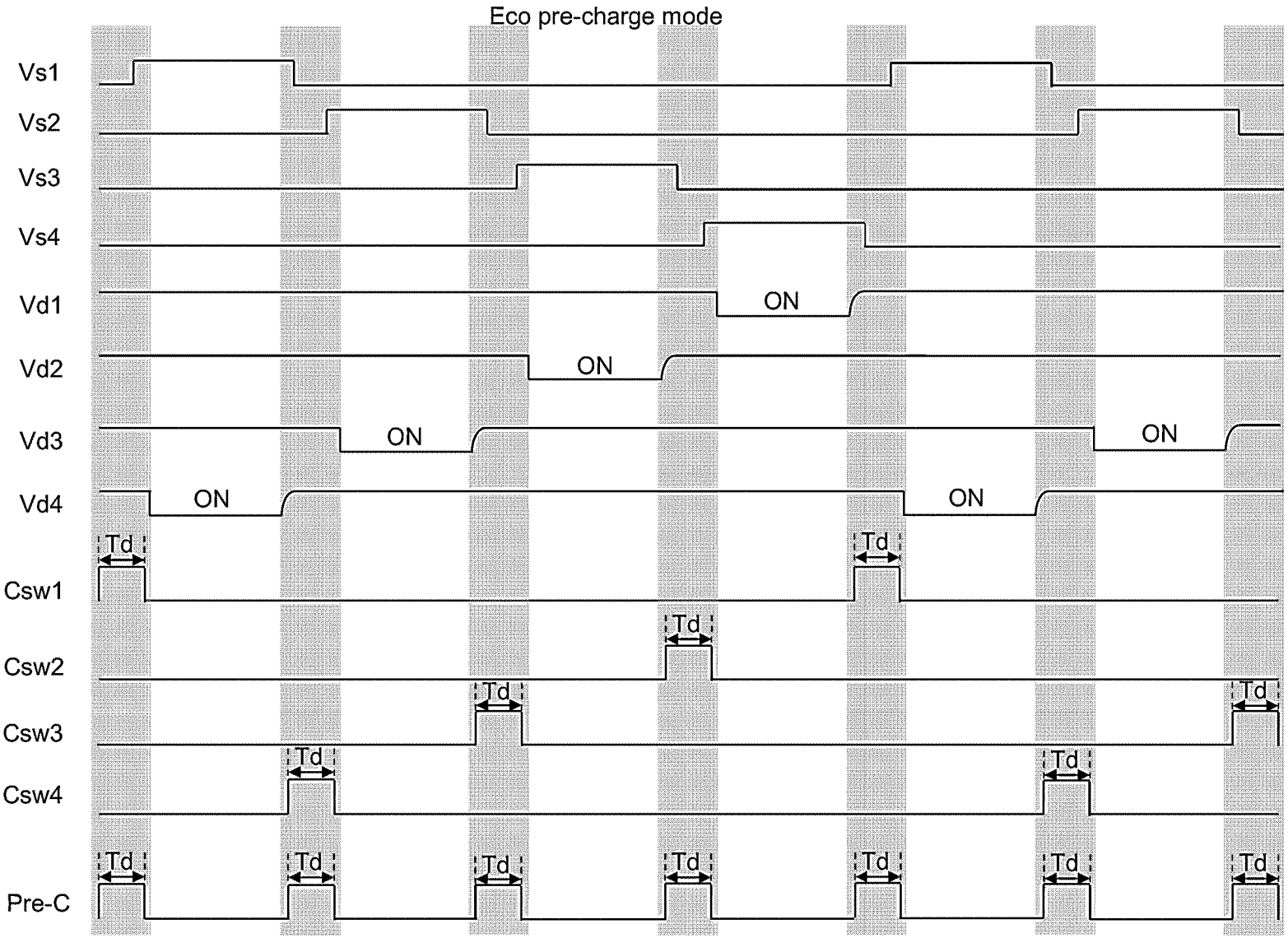
FIG. 12 illustrates a signal waveform diagram of the light emitting device array circuit under an Eco pre-charge mode in accordance with one embodiment of the present invention.

FIG. 12 illustrates a signal waveform diagram of the light emitting device array circuit under an Eco pre-charge mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4, the control signal Csw1 of the switch Sw1, the control signal Csw2 of the switch Sw2, the control signal Csw3 of the switch Sw3, the control signal Csw4 of the switch Sw4 and the pre-charge signal Pre-C are shown in FIG. 12. Please also refer to FIG. 11. In an Eco pre-charge mode, the Eco pre-charge adjustment circuit 2512 is coupled to the pixel data storage circuit 2513 and is configured to operably employ the dead time Td before lighting up the predetermined light emitting device 211 in the frame as the predetermined pre-charge time period according to the pixel data storage signal, and configured to control plural pre-charge switches Sw1, Sw2, Sw3 and Sw4 during the predetermined pre-charge time period to electrically connect the data node D1, D2, D3 or D4 of the data line Ch1, Ch2, Ch3 or Ch4 corresponding to the light emitting device 211 which has been lit up just before the predetermined light emitting device 211 to the pre-charge level VLED provided by the pre-charge control amplifier circuit 250. In one embodiment, the plural pre-charge switches Sw1, Sw2, Sw3 and Sw4 are coupled to the plural data nodes D1, D2, D3 and D4 correspondingly.

Figure 13:
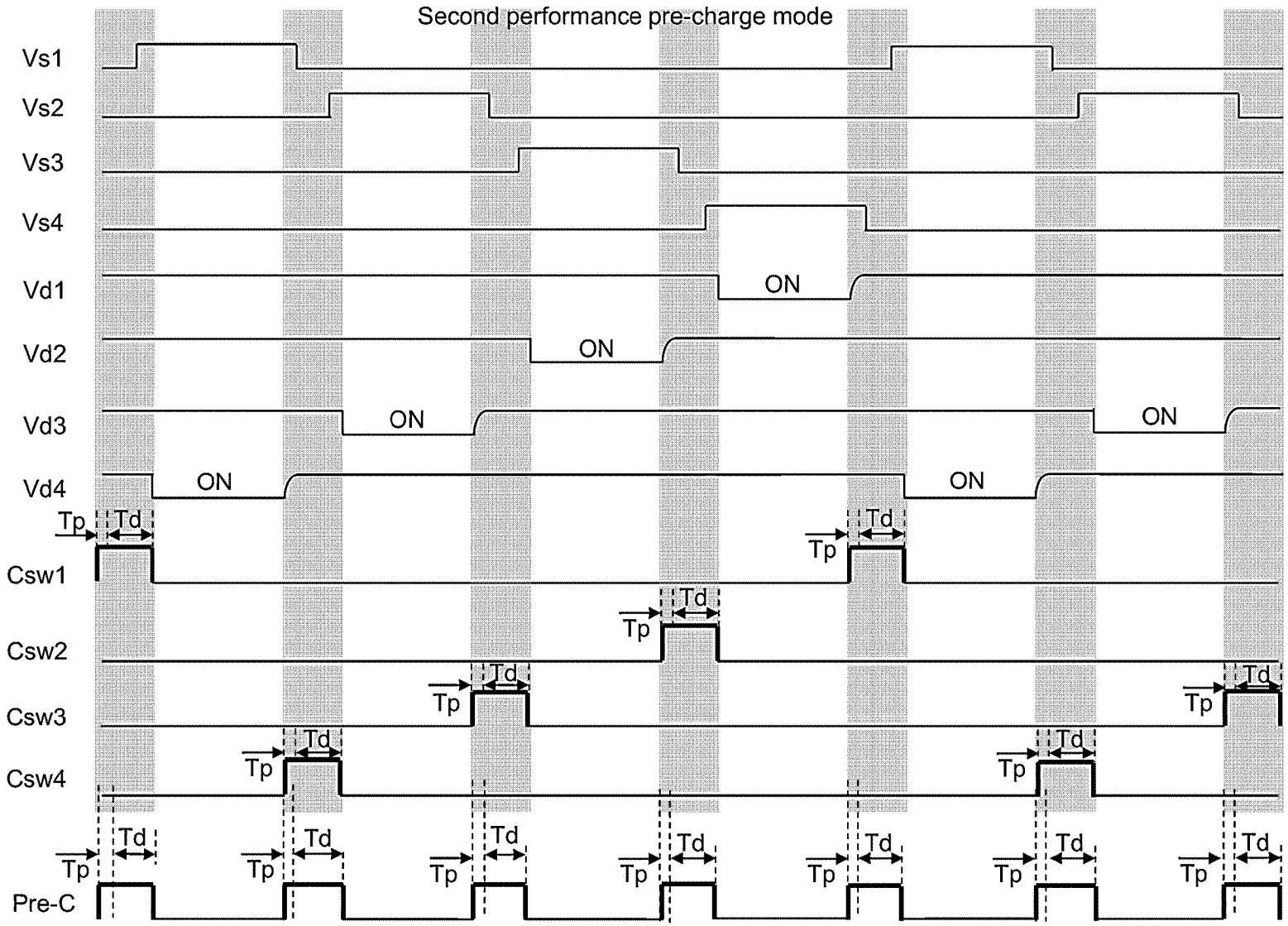
FIG. 13 illustrates a signal waveform diagram of the light emitting device array circuit under a second performance pre-charge mode in accordance with one embodiment of the present invention.

FIG. 13 illustrates a signal waveform diagram of the light emitting device array circuit under a second performance pre-charge mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4, the control signal Csw1 of the switch Sw1, the control signal Csw2 of the switch Sw2, the control signal Csw3 of the switch Sw3, the control signal Csw4 of the switch Sw4 and the pre-charge signal Pre-C are shown in FIG. 13. Please also refer to FIG. 11. In a second Eco pre-charge mode, the Eco pre-charge adjustment circuit 2512 is coupled to the pixel data storage circuit 2513 and is configured to operably employ the dead time Td before lighting up the predetermined light emitting device 211 plus a performance time Tp immediately before the dead time Td in the frame as the predetermined pre-charge time period (i.e., Td+Tp) according to the pixel data storage signal, and configured to control plural pre-charge switches Sw1, Sw2, Sw3 and Sw4 during the predetermined pre-charge time period to electrically connect the data node D1, D2, D3 or D4 of the data line Ch1, Ch2, Ch3 or Ch4 corresponding to the light emitting device 211 which has been lit up just before the predetermined light emitting device 211 to the pre-charge level VLED provided by the pre-charge control amplifier circuit 250.

Figure 14:
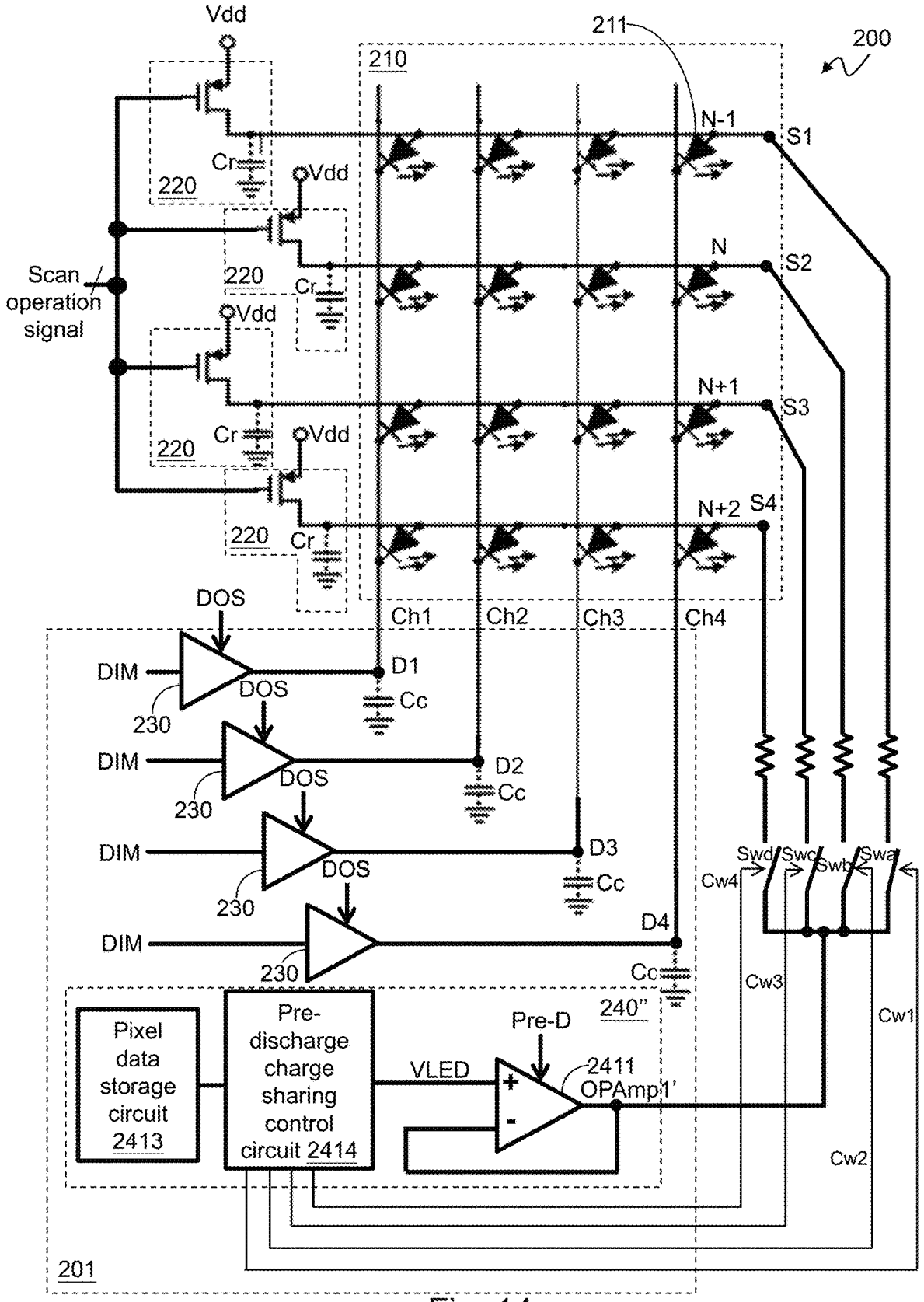
FIG. 14 illustrates a schematic diagram of a light emitting device array circuit in accordance with still another embodiment of the present invention.

FIG. 14 illustrates a schematic diagram of a light emitting device array circuit in accordance with still another embodiment of the present invention. The difference between this embodiment and the embodiment of FIG. 5 is that the pre-discharge control circuit 240" of this embodiment includes an error amplifier 2411 and a pixel data storage circuit 2413, and further includes a pre-discharge charge sharing control circuit 2414. The error amplifier 2411 and the pixel data storage circuit 2413 are similar to those in the embodiment of FIG. 5 and thus the detailed descriptions thereof are omitted.

Figure 15:
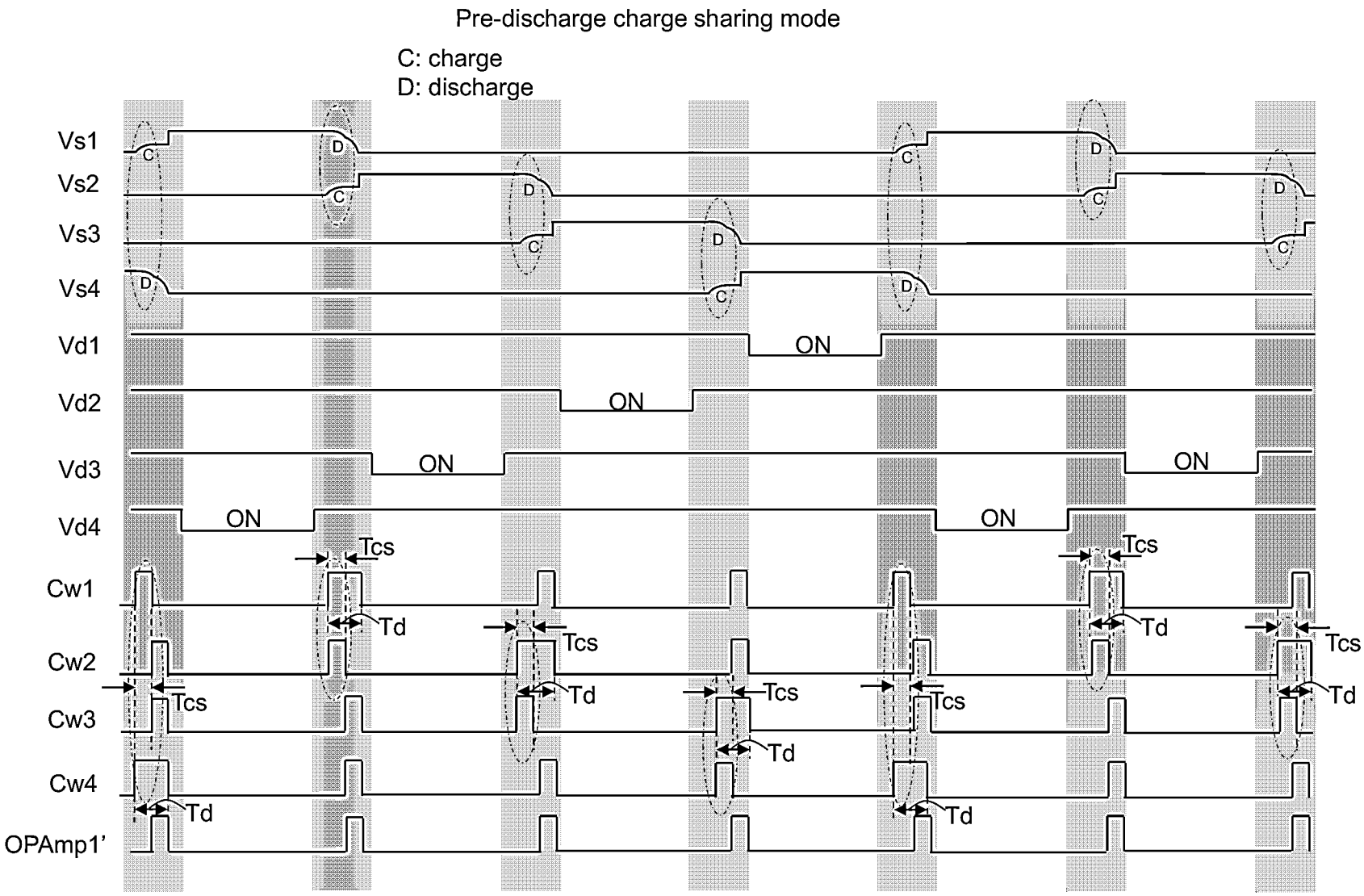
FIG. 15 illustrates a signal waveform diagram of the light emitting device array circuit under a pre-discharge charge sharing mode in accordance with one embodiment of the present invention.

FIG. 15 illustrates a signal waveform diagram of the light emitting device array circuit under a pre-discharge charge sharing mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4, the control signal Cw1 of the switch Swa, the control signal Cw2 of the switch Swb, the control signal Cw3 of the switch Swc, the control signal Cw4 of the switch Swd and the output signal OPAmp1' are shown in FIG. 15. FIG. 15 is a signal waveform diagram of the light emitting device array circuit 200 of FIG. 14 applied to the normal pre-discharge mode. Note that in addition to being applied to the normal pre-discharge mode, the pre-discharge charge sharing mode of the light emitting device array circuit 200 of FIG. 14 can also be applied to the Eco pre-discharge mode, the first performance pre-discharge mode and the second performance pre-discharge mode, as long as the forepart time Tcs and the latter part time in the dead time Td are designed not to overlap with each other.

Please refer to FIG. 14 and FIG. 15. In a pre-discharge charge sharing mode, the pre-discharge charge sharing control circuit 2414 is configured to operably control plural pre-discharge switches Swa, Swb, Swc and Swd to electrically connect the scan node S1, S2, S3 or S4 of the scan line N−1, N, N+1 or N+2 corresponding to the light emitting device 211 which has been lit up just before the predetermined light emitting device 211 to the scan node S1, S2, S3 or S4 of the scan line N−1, N, N+1 or N+2 corresponding to the predetermined light emitting device 211 during a forepart time Tcs of the dead time Td before lighting up the predetermined light emitting device 211 in the frame, so as to achieve charge sharing between the two scan nodes. For example, during the forepart time Tcs in the dead time Td, the pre-discharge switches Swa and Swb are turned ON to electrically connect the scan node S1 of the scan line N−1 corresponding to the light emitting device 211 which has been lit up just before the predetermined light emitting device 211 to the scan node S2 of the scan line N corresponding to the predetermined light emitting device 211, so as to achieve charge sharing between the two scan nodes. In one embodiment, the scan node S1 of the scan line N−1 corresponding to the light emitting device 211 which has been lit up just before the predetermined light emitting device 211 is addressed by the pixel data storage circuit 2413 of the driver circuit 201.

Figure 16:
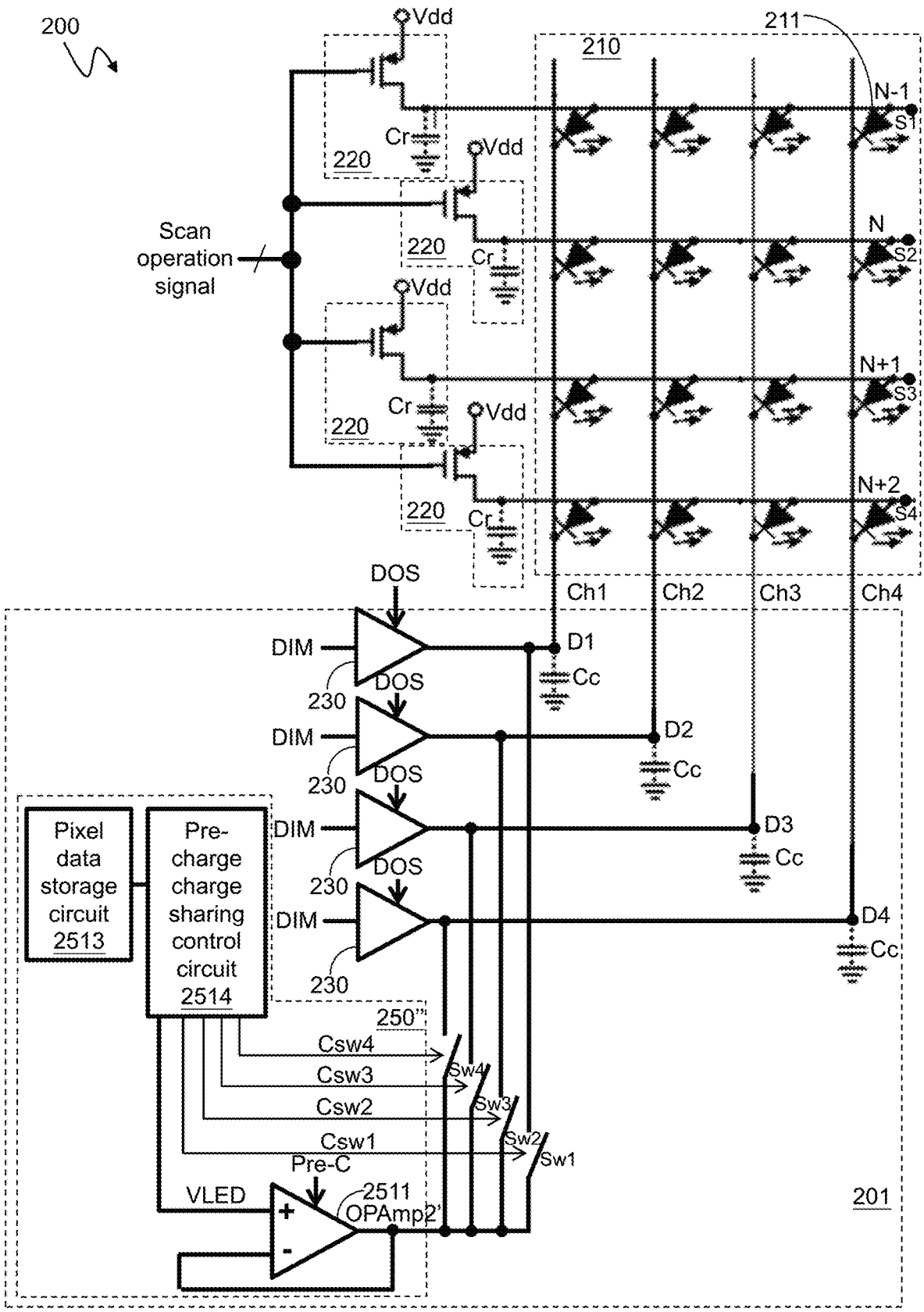
FIG. 16 illustrates a schematic diagram of a light emitting device array circuit in accordance with yet another embodiment of the present invention.

FIG. 16 illustrates a schematic diagram of a light emitting device array circuit in accordance with yet another embodiment of the present invention. The difference between this embodiment and the embodiment of FIG. 11 is that the pre-charge control amplifier circuit 250" of this embodiment includes an error amplifier 2511 and a pixel data storage circuit 2513, and further includes a pre-charge charge sharing control circuit 2514. The error amplifier 2511 and the pixel data storage circuit 2513 are similar to those in the embodiment of FIG. 11 and therefore the detailed descriptions thereof are omitted.

Figure 17:
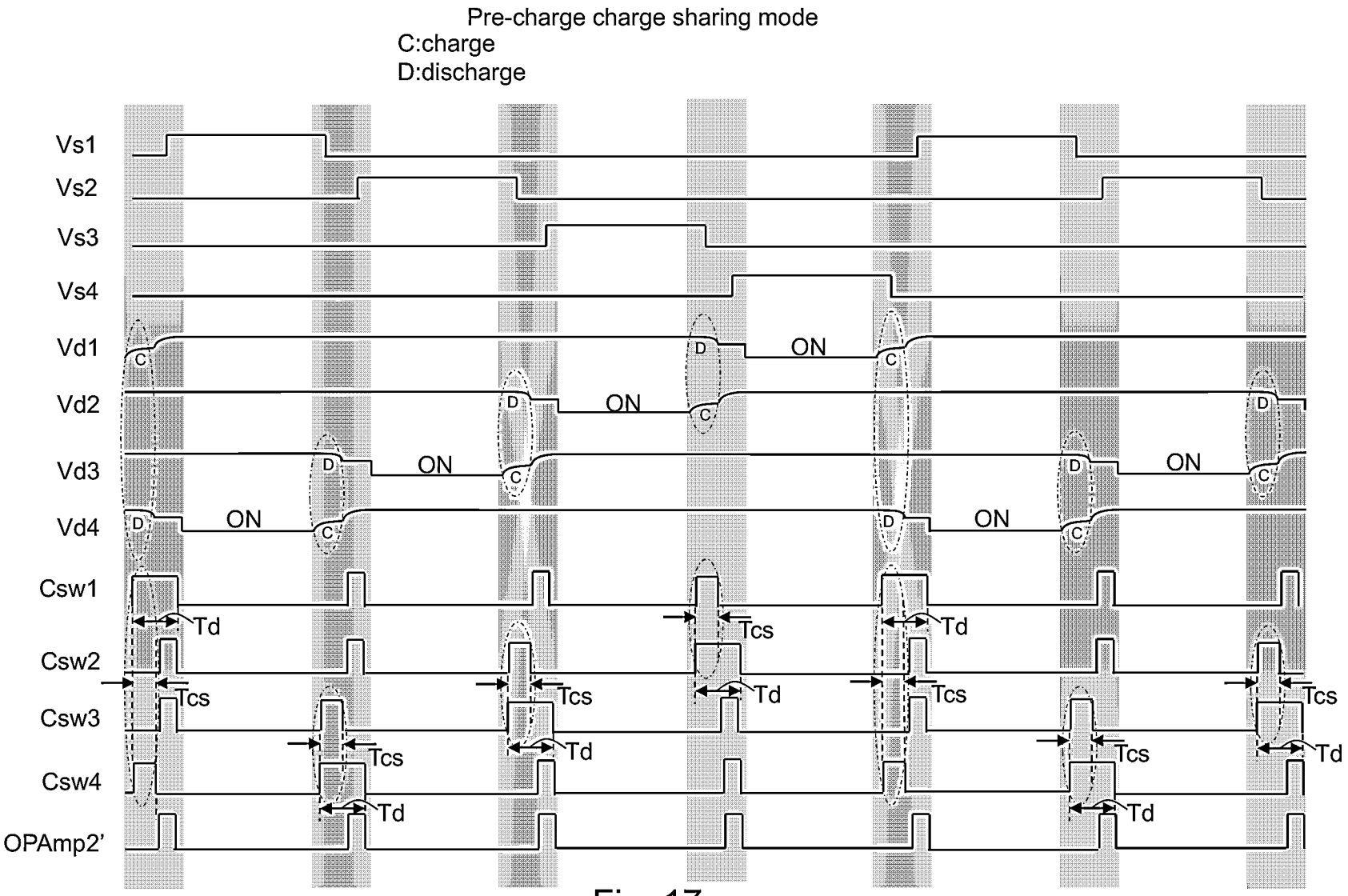
FIG. 17 illustrates a signal waveform diagram of the light emitting device array circuit under a pre-charge charge sharing mode in accordance with one embodiment of the present invention.

FIG. 17 illustrates a signal waveform diagram of the light emitting device array circuit under a pre-charge charge sharing mode in accordance with one embodiment of the present invention. The scan node voltage Vs1, the scan node voltage Vs2, the scan node voltage Vs3, the scan node voltage Vs4, the data node voltage Vd1, the data node voltage Vd2, the data node voltage Vd3, the data node voltage Vd4, the control signal Csw1 of the switch Sw1, the control signal Csw2 of the switch Sw2, the control signal Csw3 of the switch Sw3, the control signal Csw4 of the switch Sw4 and the output signal OPAmp2' are shown in FIG. 17. FIG. 17 is a signal waveform diagram of the light emitting device array circuit 200 of FIG. 16 applied to the normal pre-charge mode. Note that in addition to being applied to the normal pre-charge mode, the pre-charge charge sharing mode of the light emitting device array circuit 200 of FIG. 16 can also be applied to the Eco pre-charge mode, the first performance pre-charge mode and the second performance pre-charge mode, as long as the forepart time Tcs and the latter part time in the dead time Td are designed not to overlap with each other.

Please refer to FIG. 16 and FIG. 17. In a pre-charge charge sharing mode, the pre-charge charge sharing control circuit 2514 is configured to operably control plural pre-charge switches Sw1, Sw2, Sw3 and Sw4 to electrically connect the data node D1, D2, D3 or D4 of the data line Ch1, Ch2, Ch3 or Ch4 corresponding to the light emitting device 211 which has been lit up just before the predetermined light emitting device 211 to the data node D1, D2, D3 or D4 of the data line Ch1, Ch2, Ch3 or Ch4 corresponding to the predetermined light emitting device 211 during a forepart time Tcs of the dead time Td before lighting up the predetermined light emitting device 211 in the frame, so as to achieve charge sharing between the two data nodes. For example, during the forepart time Tcs in the dead time Td, the pre-charge switches Sw3 and Sw4 are controlled to be turned ON to electrically connect the data node D4 of the data line Ch4 corresponding to the light emitting device 211 which has been lit up just before the predetermined light emitting device 211 to the data node D3 of the data line Ch3 corresponding to the predetermined light emitting device 211, so as to achieve charge sharing between the two data nodes. In one embodiment, the data node D4 of the data line Ch4 corresponding to the light emitting device 211 which has been lit up just before the predetermined light emitting device 211 is addressed by the pixel data storage circuit 2513 of the driver circuit 201.

Note that the pre-charge control amplifier circuit 250 of FIG. 8 can be also applied to the embodiment of FIG. 2 and the pre-charge control amplifier circuit 250' and the pre-charge switches Sw1-Sw4 of FIG. 11 can be also applied to the embodiment of FIG. 5, i.e., the pre-discharge operation and the pre-charge operation can be performed in these embodiments.

Figure 18:
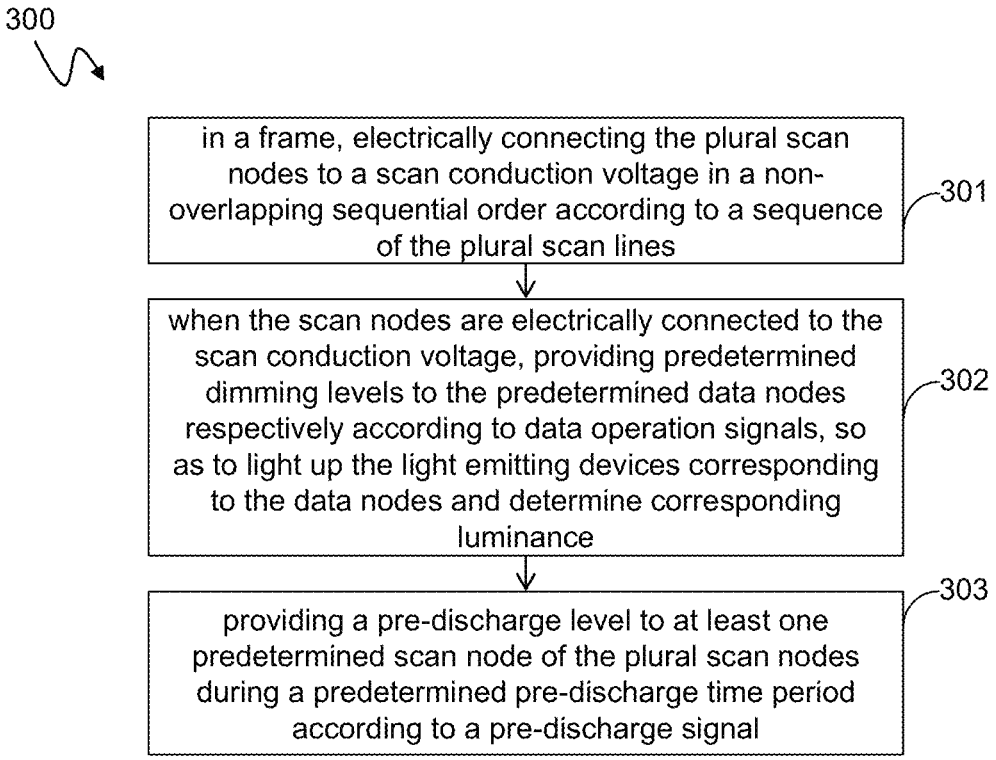
FIGS. 18-23 illustrate flow diagrams of a control method of the light emitting device array circuit capable of reducing ghost image in accordance with one embodiment of the present invention.

FIGS. 18-23 illustrate flowchart diagrams of a control method of the light emitting device array circuit capable of reducing ghost image in accordance with one embodiment of the present invention. As shown in FIG. 18, the control method 300 of the light emitting device array circuit of the present invention includes: step 301, in a frame, electrically connecting the plural scan nodes to a scan conduction voltage in a non-overlapping sequential order. Subsequently, in step 302, when the scan nodes are electrically connected to the scan conduction voltage, predetermined dimming levels are provided to the predetermined data nodes respectively according to data operation signals, so as to light up the light emitting devices corresponding to the data nodes and determine corresponding luminance. Next, in step 303, a pre-discharge level is provided to at least one predetermined scan node of the plural scan nodes during a predetermined pre-discharge time period according to a pre-discharge signal.

Figure 19:
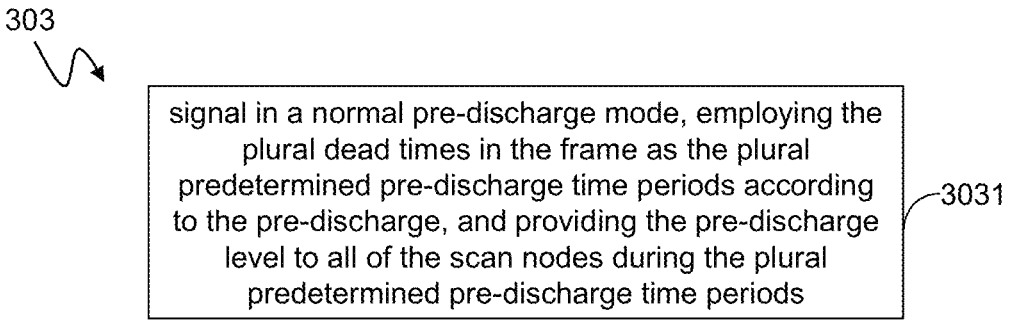
Figure 20:
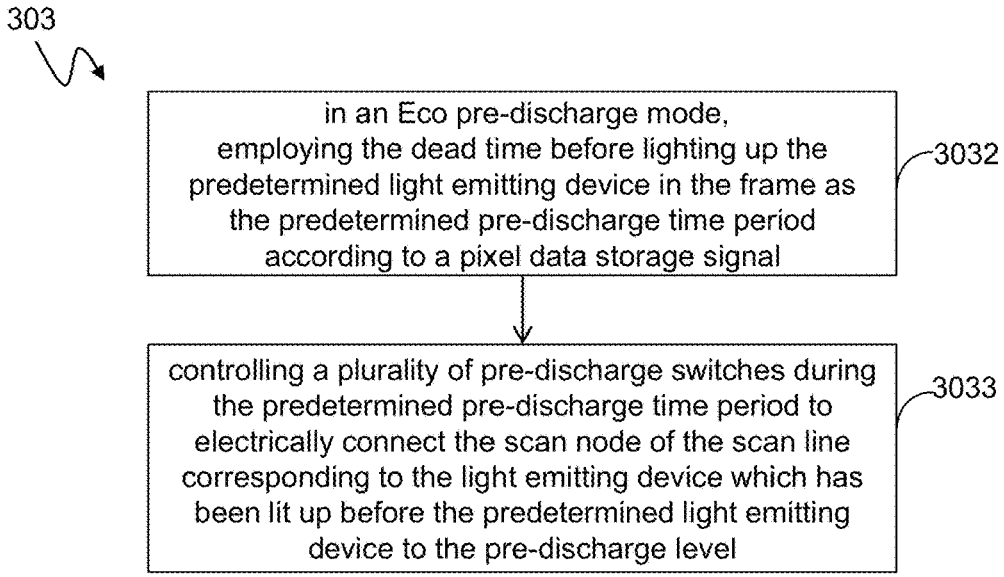

As shown in FIG. 19, in one embodiment, the step 303 includes step 3031: in a normal pre-discharge mode, employing the plural dead times in the frame as the plural predetermined pre-discharge time periods according to the pre-discharge signal, and providing the pre-discharge level to all of the scan nodes during the plural predetermined pre-discharge time periods. As shown in FIG. 20, in another embodiment, the step 303 includes step 3032 and step 3033. In step 3032, in an Eco pre-discharge mode, the dead time before lighting up the predetermined light emitting device in the frame is employed as the predetermined pre-discharge time period according to a pixel data storage signal. Subsequently, in step 3033, plural pre-discharge switches are controlled during the predetermined pre-discharge time period to electrically connect the scan node of the scan line corresponding to the light emitting device which has been lit up just before the predetermined light emitting device to the pre-discharge level.

Figure 21:
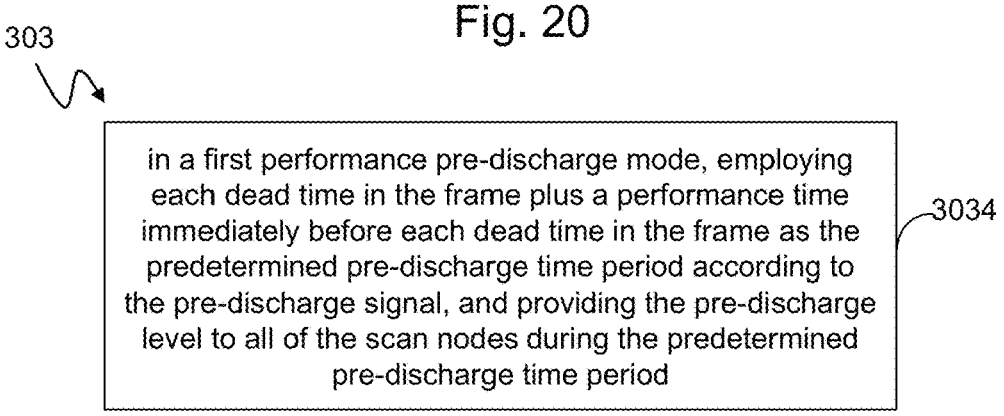

As shown in FIG. 21, in still another embodiment, the step 303 includes step 3034: in a first performance pre-discharge mode, employing each dead time in the frame plus a performance time immediately before each dead time in the frame as the predetermined pre-discharge time period according to the pre-discharge signal, and providing the pre-discharge level to all of the scan nodes during the predetermined pre-discharge time period.

Figure 22:
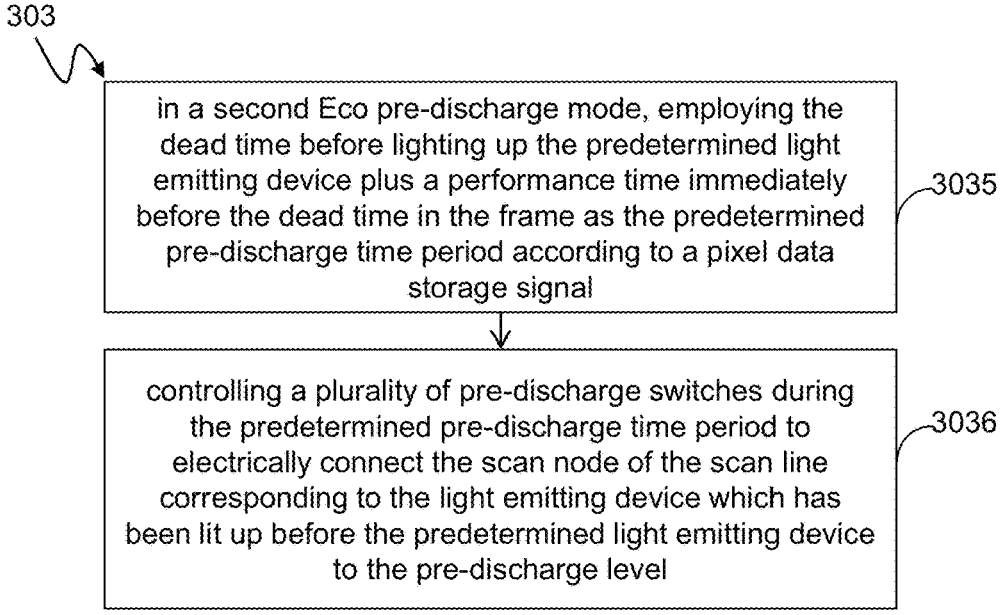

As shown in FIG. 22, in yet another embodiment, the step 303 includes step 3035 and step 3036. In step 3035, in a second Eco pre-discharge mode, the dead time before lighting up the predetermined light emitting device plus a performance time immediately before the dead time in the frame are employed as the predetermined pre-discharge time period according to a pixel data storage signal. Next, in step 3036, plural pre-discharge switches are controlled during the predetermined pre-discharge time period to electrically connect the scan node of the scan line corresponding to the light emitting device which has been lit up just before the predetermined light emitting device to the pre-discharge level.

Figure 23:
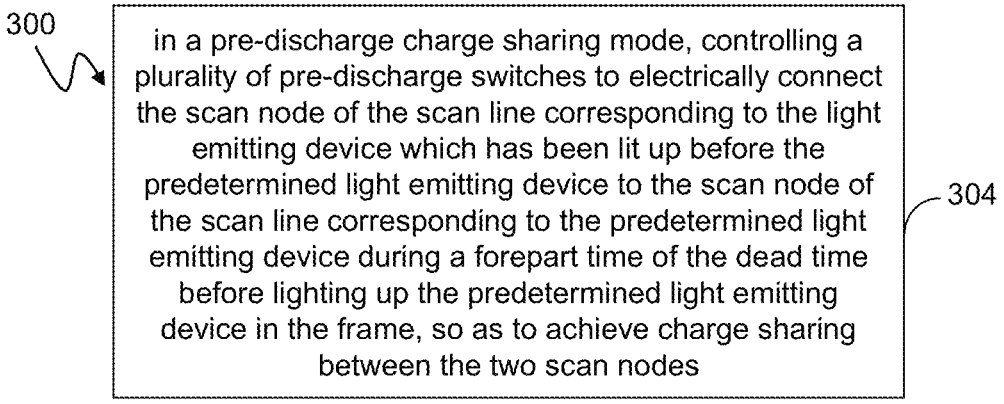

As shown in FIG. 23, the control method 300 of the light emitting device array circuit of the present invention can further include step 304: in a pre-discharge charge sharing mode, controlling plural pre-discharge switches to electrically connect the scan node of the scan line corresponding to the light emitting device which has been lit up just before the predetermined light emitting device to the scan node of the scan line corresponding to the predetermined light emitting device during a forepart time of the dead time before lighting up the predetermined light emitting device in the frame, so as to achieve charge sharing between the two scan nodes. Note that in one embodiment, the pre-discharge charge sharing mode of step 304 can be applied to (or combined into) the normal pre-discharge mode described instep 3031, the Eco pre-discharge mode described insteps 3032-3033, the first performance pre-discharge mode described in step 3034 or the second performance pre-discharge mode described in steps 3035-3036.

Figure 24:
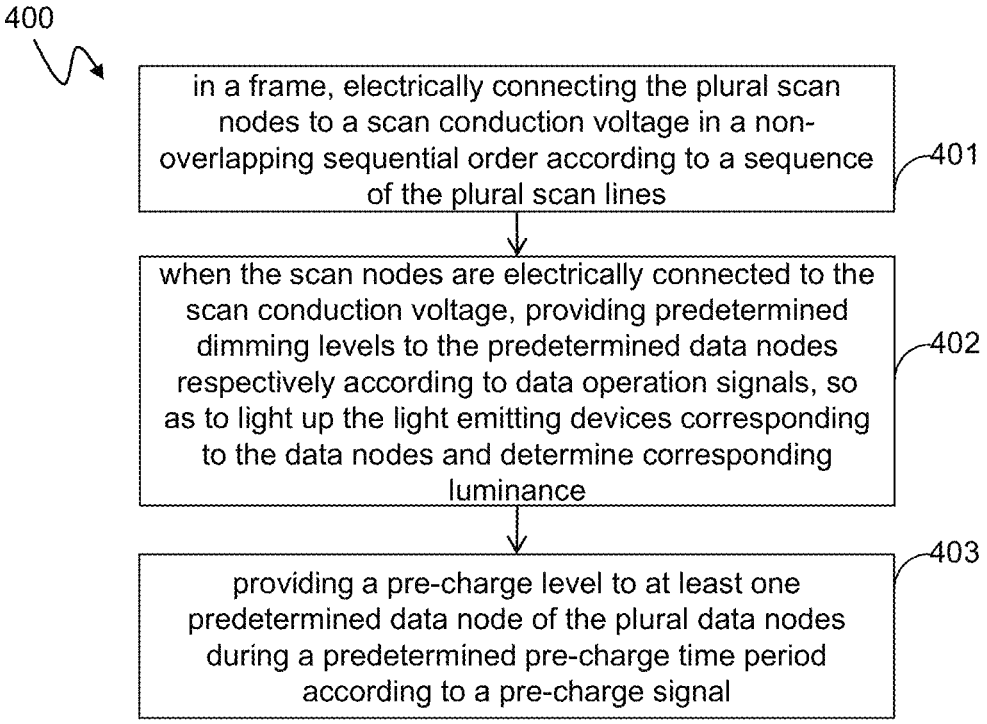
FIGS. 24-29 illustrate flow diagrams of a control method of the light emitting device array circuit capable of reducing ghost image in accordance with another embodiment of the present invention.

FIGS. 24-29 illustrate flow diagrams of a control method of the light emitting device array circuit in accordance with another embodiment of the present invention. As shown in FIG. 24, the control method 400 of the light emitting device array circuit of the present invention includes: step 401, in a frame, electrically connecting the plural scan nodes to a scan conduction voltage in a non-overlapping sequential order. Subsequently, in step 402, when the scan nodes are electrically connected to the scan conduction voltage, predetermined dimming levels are provided to the predetermined data nodes respectively according to data operation signals, so as to light up the light emitting devices corresponding to the data nodes and determine corresponding luminance. Next, in step 403, a pre-charge level is provided to at least one predetermined data node of the plural data nodes during a predetermined pre-charge time period according to a pre-charge signal.

Figure 25:
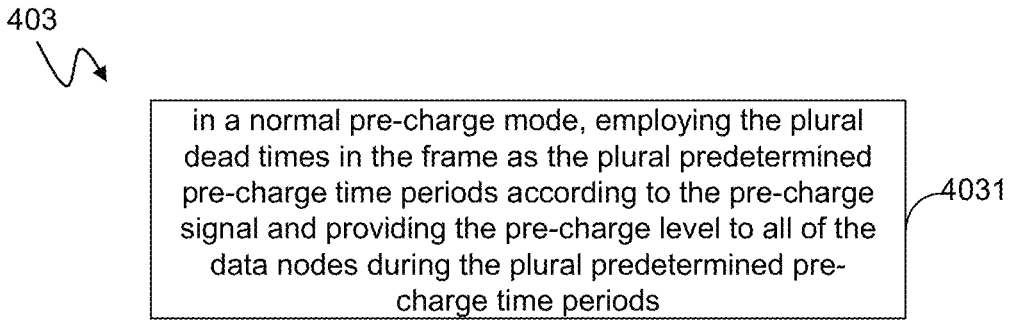

As shown in FIG. 25, in one embodiment, the step 403 includes step 4031: in a normal pre-charge mode, employing the plural dead times in the frame as the plural predetermined pre-charge time periods according to the pre-charge signal, and providing the pre-charge level to all of the data nodes during the plural predetermined pre-charge time periods.

Figure 26:
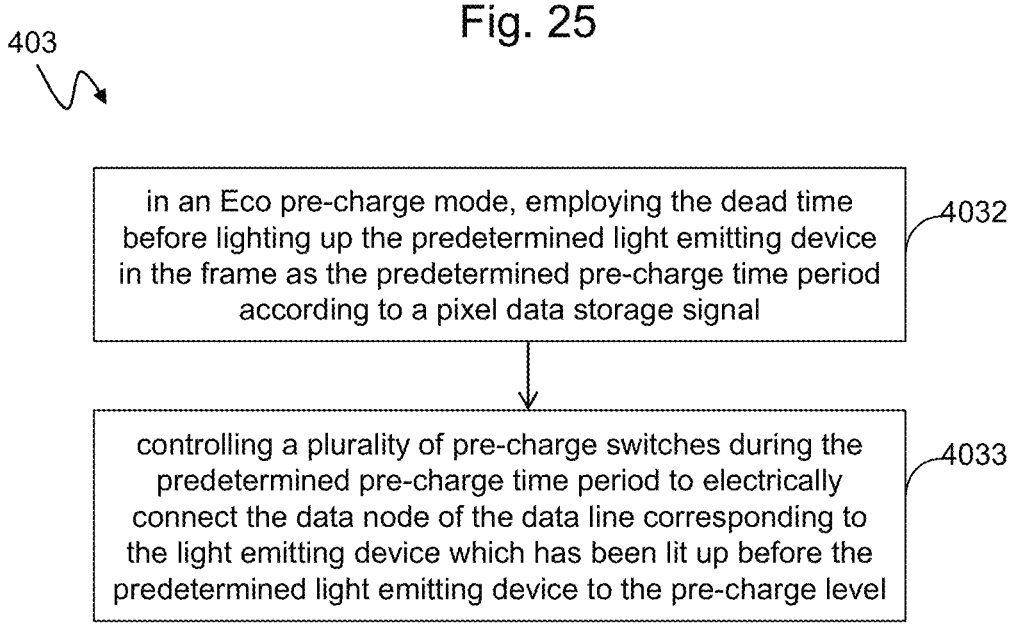

As shown in FIG. 26, in another embodiment, the step 403 includes step 4032 and step 4033. In step 4032, in an Eco pre-charge mode, the dead time before lighting up the predetermined light emitting device in the frame is employed as the predetermined pre-charge time period according to a pixel data storage signal. Subsequently, instep 4033, plural pre-charge switches are controlled during the predetermined pre-charge time period to electrically connect the data node of the data line corresponding to the light emitting device which has been lit up just before the predetermined light emitting device to the pre-charge level.

Figure 27:
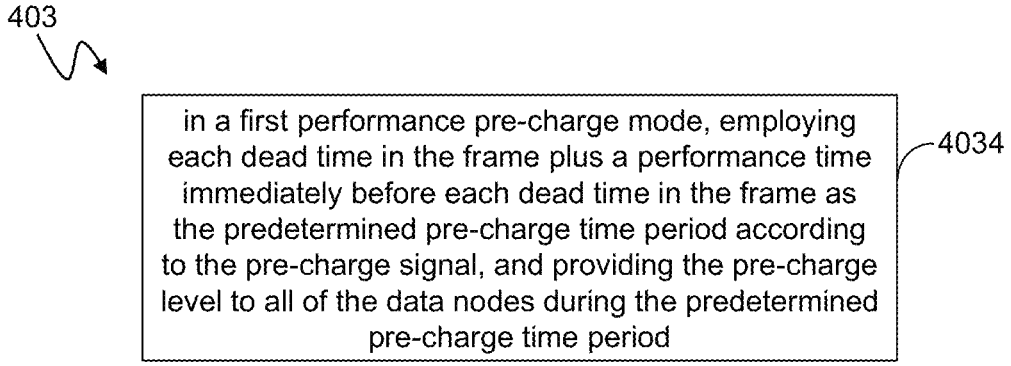

As shown in FIG. 27, in still another embodiment, the step 403 includes step 4034: in a first performance pre-charge mode, employing each dead time in the frame plus a performance time immediately before each dead time in the frame as the predetermined pre-charge time period according to the pre-charge signal, and providing the pre-charge level to all of the data nodes during the predetermined pre-charge time period.

Figure 28:
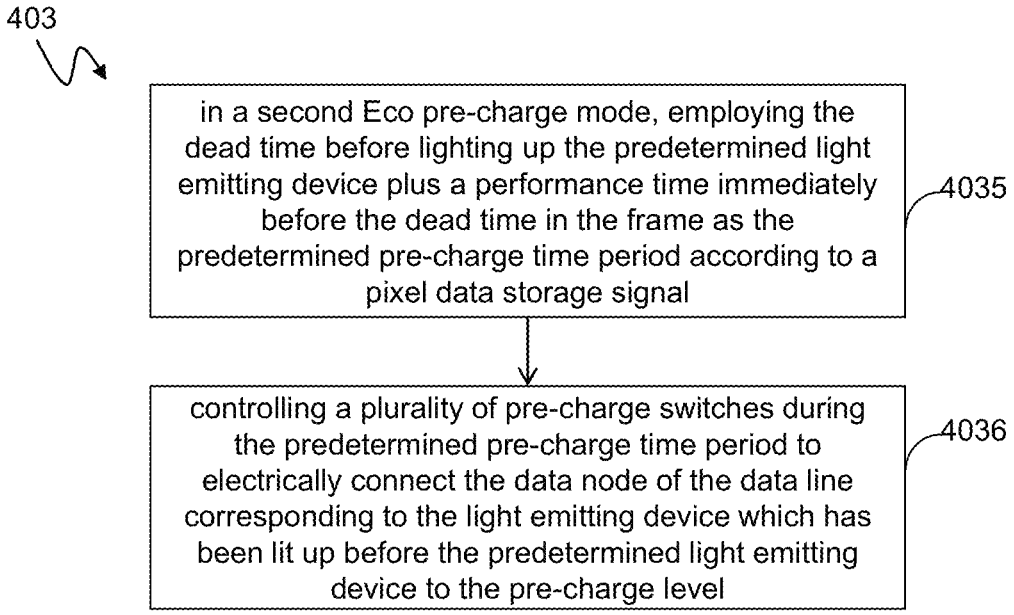

As shown in FIG. 28, in yet another embodiment, the step 403 includes step 4035 and step 4036. In step 4035, in a second Eco pre-charge mode, the dead time before lighting up the predetermined light emitting device plus a performance time immediately before the dead time in the frame are employed as the predetermined pre-charge time period according to a pixel data storage signal. Next, in step 4036, plural pre-charge switches are controlled during the predetermined pre-charge time period to electrically connect the data node of the data line corresponding to the light emitting device which has been lit up just before the predetermined light emitting device to the pre-charge level.

Figure 29:
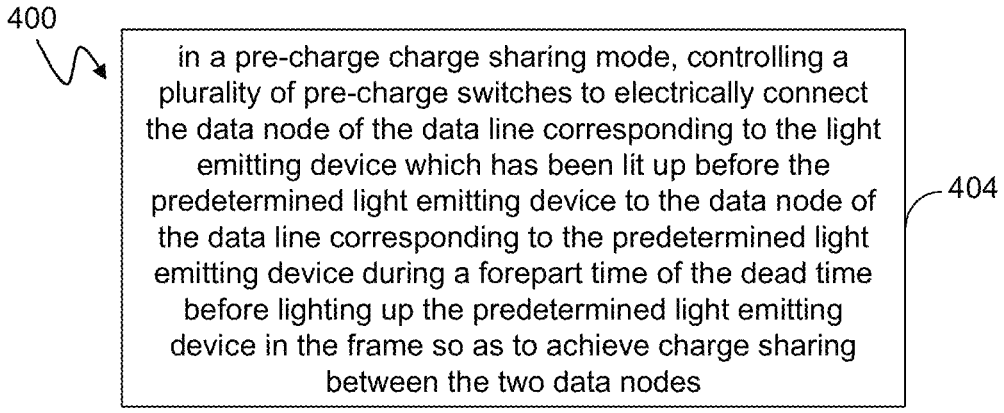

As shown in FIG. 29, the control method 400 of the light emitting device array circuit of the present invention can further include step 404: in a pre-charge charge sharing mode,f controlling plural pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame, so as to achieve charge sharing between the two data nodes. Note that in one embodiment, the pre-charge charge sharing mode of step 404 can be applied to (or combined into) the normal pre-charge mode described in step 4031, the Eco pre-charge mode described in steps 4032-4033, the first performance pre-charge mode described in step 4034 or the second performance pre-charge mode described in steps 4035-4036.

Note that step 403 in FIG. 24, step 4031 in FIG. 25, steps 4032 and 4033 in FIG. 26, step 4034 in FIG. 27, steps 4035 and 4036 in FIG. 28 or step 404 in FIG. 29 can be also applied to (or combined into) the embodiment of FIG. 18, i.e., these pre-charge and pre-discharge operations can be performed in the embodiment of FIG. 18.

Note that the sequence for lighting up the light emitting device 211 shown in the signal waveform diagram illustrated in the embodiment, which is to diagonally light up the light emitting devices 211 in the light emitting device array 210 in a sequential order, is an example for illustrating the spirit of the present invention, but not for limiting the timing and other arrangements of the light emitting devices 211 of the broadest scope of the present invention; the present invention can be applied to other arrangements.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. Other steps which do not affect the main function can be inserted between two directly-connected steps in the figures of various embodiments as long as not affecting the achievement of the purpose of the present invention. In view of the foregoing, the spirit of the present invention should cover all such and other modifications and variations, which should be interpreted to fall within the scope of the following claims and their equivalents. It is not limited for each of the embodiments described hereinbefore to be used alone; under the spirit of the present invention, two or more of the embodiments described hereinbefore can be used in combination. For example, two or more of the embodiments can be used together, or, a part of one embodiment can be used to replace a corresponding part of another embodiment.

What is claimed is:

1. A light emitting device array circuit comprising:

a light emitting device array including a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node;

a plurality of scan line switch circuits respectively and correspondingly coupled to the plurality of scan nodes, wherein in a frame, the plurality of scan line switch circuits respectively electrically connect the corresponding scan nodes to a scan conduction voltage in a non-overlapping sequential order; and a driver circuit including:

a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-discharge control circuit coupled to the plurality of scan nodes and configured to operably provide a pre-discharge level to at least one predetermined scan node of the plurality of scan nodes during a predetermined pre-discharge time period according to a pre-discharge signal;

wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node;

wherein the predetermined pre-discharge time period is correlated with the dead time.

2. The light emitting device array circuit of claim 1, wherein the pre-discharge level is correlated with a difference between the scan conduction voltage and a predetermined voltage drop.

3. The light emitting device array circuit of claim 1, wherein in a normal pre-discharge mode, there are a plurality of predetermined pre-discharge time periods and a plurality of dead times in one frame, and wherein the pre-discharge control circuit employs the plurality of dead times in the frame as the plurality of predetermined pre-discharge time periods and provides the pre-discharge level to all of the scan nodes during the plurality of predetermined pre-discharge time periods according to the pre-discharge signal.

4. The light emitting device array circuit of claim 1, wherein the driver circuit further includes:

a pixel data storage circuit configured to operably store a pixel data storage signal, wherein the pixel data storage signal is configured to operably indicate a timing arrangement for lighting up the plurality of light emitting devices; and an Eco pre-discharge adjustment circuit coupled to the pixel data storage circuit and configured to operably employ the dead time before lighting up the predetermined light emitting device in the frame as the predetermined pre-discharge time period according to the pixel data storage signal in an Eco pre-discharge mode, and configured to control a plurality of pre-discharge switches during the predetermined pre-discharge time period to electrically connect the scan node of the scan line corresponding to the light emitting device which has been lit up just before the predetermined light emitting device to the pre-discharge level provided by the pre-discharge control circuit;

wherein the plurality of pre-discharge switches are coupled to the plurality of scan nodes correspondingly.

5. The light emitting device array circuit of claim 1, wherein in a first performance pre-discharge mode, the pre-discharge control circuit employs each dead time in the frame plus a performance time immediately before each dead time in the frame as the predetermined pre-discharge time period and provides the pre-discharge level to all of the scan nodes during the predetermined pre-discharge time period according to the pre-discharge signal.

6. The light emitting device array circuit of claim 1, wherein the driver circuit further includes:

a pixel data storage circuit configured to operably store a pixel data storage signal, wherein the pixel data storage signal is configured to operably indicate a timing arrangement for lighting up the plurality of light emitting devices; and an Eco pre-discharge adjustment circuit coupled to the pixel data storage circuit and configured to operably employ the dead time before lighting up the predetermined light emitting device plus a performance time immediately before the dead time in the frame as the predetermined pre-discharge time period according to the pixel data storage signal in a second Eco pre-discharge mode, and configured to control a plurality of pre-discharge switches during the predetermined pre-discharge time period to electrically connect the scan node of the scan line corresponding to the light emitting device which has been lit up just before the predetermined light emitting device to the pre-discharge level provided by the pre-discharge control circuit;

wherein the plurality of pre-discharge switches are coupled to the plurality of scan nodes correspondingly.

7. The light emitting device array circuit of claim 1, wherein the driver circuit further includes a pre-charge control amplifier circuit coupled to the plurality of data nodes and configured to operably provide a pre-charge level to at least one predetermined data node of the plurality of data nodes during a predetermined pre-charge time period according to a pre-charge signal; wherein the predetermined pre-charge time period is correlated with the dead time.

8. The light emitting device array circuit of claim 7, wherein in a normal pre-charge mode, there are a plurality of predetermined pre-charge time periods and a plurality of dead times in one frame, and wherein the pre-charge control amplifier circuit employs the plurality of dead times in the frame as the plurality of predetermined pre-charge time periods and provides the pre-charge level to all of the data nodes during the plurality of predetermined pre-charge time periods according to the pre-charge signal.

9. The light emitting device array circuit of claim 7, wherein the driver circuit further includes:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device in the frame as the predetermined pre-charge time period according to the pixel data storage signal in an Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit;

wherein the plurality of pre-charge switches are coupled to the plurality of data nodes correspondingly.

10. The light emitting device array circuit of claim 7, wherein in a first performance pre-charge mode, the pre-charge control amplifier circuit employs each dead time in the frame plus a performance time immediately before each dead time in the frame as the predetermined pre-charge time period according to the pre-charge signal, and provides the pre-charge level to all of the data nodes during the predetermined pre-charge time period.

11. The light emitting device array circuit of claim 7, wherein the driver circuit further includes:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device plus a performance time immediately before the dead time in the frame as the predetermined pre-charge time period according to the pixel data storage signal in a second Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit;

wherein the plurality of pre-charge switches are coupled to the plurality of data nodes correspondingly.

12. The light emitting device array circuit of claim 7, wherein the driver circuit further includes a pre-charge charge sharing control circuit, wherein in a pre-charge charge sharing mode, the pre-charge charge sharing control circuit is configured to operably control a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame in a pre-charge charge sharing mode, so as to achieve charge sharing between the two data nodes;

wherein the plurality of pre-charge switches are coupled to the plurality of data nodes correspondingly;

wherein the data node of the data line corresponding to the light emitting device which has been lit up just before the predetermined light emitting device is addressed by a pixel data storage circuit of the driver circuit.

13. The light emitting device array circuit of claim 1, wherein the driver circuit further includes a pre-discharge charge sharing control circuit, wherein in a pre-discharge charge sharing mode, the pre-discharge charge sharing control circuit is configured to operably control a plurality of pre-discharge switches to electrically connect the scan node of the scan line corresponding to the light emitting device which has been lit up just before the predetermined light emitting device to the scan node of the scan line corresponding the predetermined light emitting device during a forepart time of the dead time before lighting up the predetermined light emitting device in the frame, so as to achieve charge sharing between the two scan nodes;

wherein the plurality of pre-discharge switches are coupled to the plurality of scan nodes correspondingly;

wherein the scan node of the scan line corresponding to the light emitting device which has been lit up just before the predetermined light emitting device is addressed by a pixel data storage circuit of the driver circuit.

14. A light emitting device array circuit comprising:

a light emitting device array including a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node;

a plurality of scan line switch circuits respectively and correspondingly coupled to the plurality of scan nodes, wherein in a frame, the plurality of scan line switch circuits respectively electrically connect the corresponding scan nodes to a scan conduction voltage in a non-overlapping sequential order; and a driver circuit including:

a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-charge control amplifier circuit coupled to the plurality of data nodes and configured to operably provide a pre-charge level to at least one predetermined data node of the plurality of data nodes during a predetermined pre-charge time period according to a pre-charge signal;

wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node;

wherein the predetermined pre-charge time period is correlated with the dead time.

15. The light emitting device array circuit of claim 14, wherein in a normal pre-charge mode, there are a plurality of predetermined pre-charge time periods and a plurality of dead times in one frame, and wherein the pre-charge control amplifier circuit employs the plurality of dead times in the frame as the plurality of predetermined pre-charge time periods and provides the pre-charge level to all of the data nodes during the plurality of predetermined pre-charge time periods according to the pre-charge signal.

16. The light emitting device array circuit of claim 14, wherein the driver circuit further includes:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device in the frame as the predetermined pre-charge time period according to the pixel data storage signal in an Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control circuit;

wherein the plurality of pre-charge switches are coupled to the plurality of data nodes correspondingly.

17. The light emitting device array circuit of claim 14, wherein in a first performance pre-charge mode, the pre-charge control amplifier circuit employs each dead time in the frame plus a performance time immediately before each dead time in the frame as the predetermined pre-charge time period according to the pre-charge signal, and provides the pre-charge level to all of the data nodes during the predetermined pre-charge time period.

18. The light emitting device array circuit of claim 14, wherein the driver circuit further includes:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device plus a performance time immediately before the dead time in the frame as the predetermined pre-charge time period according to the pixel data storage signal in a second Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit;

wherein the plurality of pre-charge switches are coupled to the plurality of data nodes correspondingly.

19. The light emitting device array circuit of claim 14, wherein the driver circuit further includes a pre-charge charge sharing control circuit, wherein in a pre-charge charge sharing mode, the pre-charge charge sharing control circuit is configured to operably control a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame in a pre-charge charge sharing mode, so as to achieve charge sharing between the two data nodes;

wherein the plurality of pre-charge switches are coupled to the plurality of data nodes correspondingly;

wherein the data node of the data line corresponding to the light emitting device which has been lit up just before the predetermined light emitting device is addressed by a pixel data storage circuit of the driver circuit.

20. A driver circuit of a light emitting device array circuit, wherein the driver circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; wherein the plurality of scan nodes are correspondingly coupled to a plurality of scan line switch circuits, wherein in a frame, the plurality of scan line switch circuits respectively electrically connect the corresponding scan nodes to a scan conduction voltage in a non-overlapping sequential order; the driver circuit comprising:

a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-discharge control circuit coupled to the plurality of scan nodes and configured to operably provide a pre-discharge level to at least one predetermined scan node of the plurality of scan nodes during a predetermined pre-discharge time period according to a pre-discharge signal;

wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node;

wherein the predetermined pre-discharge time period is correlated with the dead time.

21. The driver circuit of claim 20, wherein the pre-discharge level is correlated with a difference between the scan conduction voltage and a predetermined voltage drop.

22. The driver circuit of claim. 20, wherein in a normal pre-discharge mode, there are a plurality of predetermined pre-discharge time periods and a plurality of dead times in one frame, and wherein the pre-discharge control circuit employs the plurality of dead times in the frame as the plurality of predetermined pre-discharge time periods and provides the pre-discharge level to all of the scan nodes during the plurality of predetermined pre-discharge time periods according to the pre-discharge signal.

23. The driver circuit of claim 20, further comprising:

a pixel data storage circuit configured to operably store a pixel data storage signal, wherein the pixel data storage signal is configured to operably indicate a timing arrangement for lighting up the plurality of light emitting devices; and an Eco pre-discharge adjustment circuit coupled to the pixel data storage circuit and configured to operably employ the dead time before lighting up the predetermined light emitting device in the frame as the predetermined pre-discharge time period according to the pixel data storage signal in an Eco pre-discharge mode, and configured to control a plurality of pre-discharge switches during the predetermined pre-discharge time period to electrically connect the scan node of the scan line corresponding to the light emitting device which has been lit up just before the predetermined light emitting device to the pre-discharge level provided by the pre-discharge control circuit;

wherein the plurality of pre-discharge switches are coupled to the plurality of scan nodes correspondingly.

24. The driver circuit of claim 20, wherein in a first performance pre-discharge mode, the pre-discharge control circuit employs each dead time in the frame plus a performance time immediately before each dead time in the frame as the predetermined pre-discharge time period and provides the pre-discharge level to all of the scan nodes during the predetermined pre-discharge time period according to the pre-discharge signal.

25. The driver circuit of claim 20, further comprising:

a pixel data storage circuit configured to operably store a pixel data storage signal, wherein the pixel data storage signal is configured to operably indicate a timing arrangement for lighting up the plurality of light emitting devices; and an Eco pre-discharge adjustment circuit coupled to the pixel data storage circuit and configured to operably employ the dead time before lighting up the predetermined light emitting device plus a performance time immediately before the dead time in the frame as the predetermined pre-discharge time period according to the pixel data storage signal in a second Eco pre-discharge mode, and configured to control a plurality of pre-discharge switches during the predetermined pre-discharge time period to electrically connect the scan node of the scan line corresponding to the light emitting device which has been lit up just before the predetermined light emitting device to the pre-discharge level provided by the pre-discharge control circuit;

wherein the plurality of pre-discharge switches are coupled to the plurality of scan nodes correspondingly.

26. The driver circuit of claim 20, further comprising a pre-charge control amplifier circuit coupled to the plurality of data nodes and configured to operably provide a pre-charge level to at least one predetermined data node of the plurality of data nodes during a predetermined pre-charge time period according to a pre-charge signal; wherein the predetermined pre-charge time period is correlated with the dead time.

27. The driver circuit of claim. 26, wherein in a normal pre-discharge mode, there are a plurality of predetermined pre-discharge time periods and a plurality of dead times in one frame, and wherein the pre-discharge control circuit employs the plurality of dead times in the frame as the plurality of predetermined pre-discharge time periods and provides the pre-discharge level to all of the scan nodes during the plurality of predetermined pre-discharge time periods according to the pre-discharge signal.

28. The driver circuit of claim 26, further comprising:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device in the frame as the predetermined pre-charge time period according to the pixel data storage signal in an Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit;

wherein the plurality of pre-charge switches are coupled to the plurality of data nodes correspondingly.

29. The driver circuit of claim 26, wherein in a first performance pre-charge mode, the pre-charge control amplifier circuit employs each dead time in the frame plus a performance time immediately before each dead time in the frame as the predetermined pre-charge time period according to the pre-charge signal, and provides the pre-charge level to all of the data nodes during the predetermined pre-charge time period.

30. The driver circuit of claim 26, further comprising:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device plus a performance time immediately before the dead time in the frame as the predetermined pre-charge time period according to the pixel data storage signal in a second Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit;

wherein the plurality of pre-charge switches are coupled to the plurality of data nodes correspondingly.

31. The driver circuit of claim 26, further comprising a pre-charge charge sharing control circuit configured to operably control a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame in a pre-charge charge sharing mode, so as to achieve charge sharing between the two data nodes;

wherein the plurality of pre-charge switches are coupled to the plurality of data nodes correspondingly;

wherein the data node of the data line corresponding to the light emitting device which has been lit up just before the predetermined light emitting device is addressed by a pixel data storage circuit of the driver circuit.

32. The driver circuit of claim 20, further comprising a pre-discharge charge sharing control circuit configured to operably control a plurality of pre-discharge switches to electrically connect the scan node of the scan line corresponding to the light emitting device which has been lit up just before the predetermined light emitting device to the scan node of the scan line corresponding to the predetermined light emitting device during a forepart time of the dead time before lighting up the predetermined light emitting device in the frame in a pre-discharge charge sharing mode, so as to achieve charge sharing between the two scan nodes;

wherein the plurality of pre-discharge switches are coupled to the plurality of scan nodes correspondingly;

wherein the scan node of the scan line corresponding to the light emitting device which has been lit up just before the predetermined light emitting device is addressed by a pixel data storage circuit of the driver circuit.

33. A driver circuit of a light emitting device array circuit, wherein the driver circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node;

wherein the plurality of scan nodes are correspondingly coupled to a plurality of scan line switch circuits, wherein in a frame, the plurality of scan line switch circuits respectively electrically connect the corresponding scan nodes to a scan conduction voltage in a non-overlapping sequential order; the driver circuit comprising:

a plurality of data line buffer circuits respectively and correspondingly coupled to the plurality of data nodes, wherein the data line buffer circuits are configured to operably provide or not provide predetermined dimming levels to the corresponding data nodes respectively according to data operation signals; and a pre-charge control amplifier circuit coupled to the plurality of data nodes and configured to operably provide a pre-charge level to at least one predetermined data node of the plurality of data nodes during a predetermined pre-charge time period according to a pre-charge signal;

wherein there is a dead time between a time point at which one of the data line buffer circuits changes from providing the predetermined dimming level to the corresponding data node to not providing the predetermined dimming level to the corresponding data node and a time point at which another one of the data line buffer circuits which corresponds to the light emitting device to be lit up in a next scan line changes from not providing the predetermined dimming level to the corresponding data node to providing the predetermined dimming level to the corresponding data node;

wherein the predetermined pre-charge time period is correlated with the dead time.

34. The driver circuit of claim 33, wherein in a normal pre-charge mode, there are a plurality of predetermined pre-charge time periods and a plurality of dead times in one frame, and wherein the pre-charge control amplifier circuit employs the plurality of dead times in the frame as the plurality of predetermined pre-charge time periods and provides the pre-charge level to all of the data nodes during the plurality of predetermined pre-charge time periods according to the pre-charge signal.

35. The driver circuit of claim 33, further comprising:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device in the frame as the predetermined pre-charge time period according to the pixel data storage signal in an Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit;

wherein the plurality of pre-charge switches are coupled to the plurality of data nodes correspondingly.

36. The driver circuit of claim 33, wherein in a first performance pre-charge mode, the pre-charge control amplifier circuit employs each dead time in the frame plus a performance time immediately before each dead time in the frame as the predetermined pre-charge time period according to the pre-charge signal, and provides the pre-charge level to all of the data nodes during the predetermined pre-charge time period.

37. The driver circuit of claim 33, further comprising:

a pixel data storage circuit configured to operably store a pixel data storage signal, wherein the pixel data storage signal is configured to operably indicate a timing arrangement for lighting up the plurality of light emitting devices; and an Eco pre-charge adjustment circuit coupled to the pixel data storage circuit and configured to operably employ the dead time before lighting up the predetermined light emitting device plus a performance time immediately before the dead time in the frame as the predetermined pre-charge time period according to the pixel data storage signal in a second Eco pre-charge mode, and configured to control a plurality of pre-charge switches during the predetermined pre-charge time period to electrically connect the data node of the data line corresponding to the light emitting device which has been lit up just before the predetermined light emitting device to the pre-charge level provided by the pre-charge control amplifier circuit;

wherein the plurality of pre-charge switches are coupled to the plurality of data nodes correspondingly.

38. The driver circuit of claim 33, further comprising a pre-charge charge sharing control circuit, wherein in a pre-charge charge sharing mode, the pre-discharge charge sharing control circuit is configured to operably control a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame, so as to achieve charge sharing between the two data nodes;

wherein the plurality of pre-charge switches are coupled to the plurality of data nodes correspondingly;

wherein the data node of the data line corresponding to the light emitting device which has been lit up just before the predetermined light emitting device is addressed by a pixel data storage circuit of the driver circuit.

39. A control method of a light emitting device array circuit, wherein the light emitting device array circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; the control method comprising:

in a frame, electrically connecting the plurality of scan nodes to a scan conduction voltage in a non-overlapping sequential order;

when the scan nodes are electrically connected to the scan conduction voltage, providing predetermined dimming levels to predetermined ones of the data nodes respectively according to data operation signals, so as to light up the light emitting devices corresponding to the data nodes correspond and determine corresponding luminance;

providing a pre-discharge level to at least one predetermined scan node of the plurality of scan nodes during a predetermined pre-discharge time period according to a pre-discharge signal;

wherein there is a dead time between a time point at which providing the predetermined dimming level to one of the data nodes is changed to not providing the predetermined dimming level to said one of the data nodes and a time point at which not providing the predetermined dimming level to another one of the data nodes which corresponds to the light emitting device to be lit up in a next scan line is changed to providing the predetermined dimming level to said another one of the data nodes;

wherein the predetermined pre-discharge time period is correlated with the dead time.

40. The control method of claim 39, wherein the pre-discharge level is correlated with a difference between the scan conduction voltage and a predetermined voltage drop.

41. The control method of claim 39, wherein in a normal pre-discharge mode, there are a plurality of predetermined pre-discharge time periods and a plurality of dead times in one frame, and wherein the step of providing a pre-discharge level to at least one predetermined scan node of the plurality of scan nodes during a predetermined pre-discharge time period according to a pre-discharge signal includes: employing the plurality of dead times in the frame as the plurality of predetermined pre-discharge time periods according to the pre-discharge signal, and providing the pre-discharge level to all of the scan nodes during the plurality of predetermined pre-discharge time periods.

42. The control method of claim 39, wherein the step of providing a pre-discharge level to at least one predetermined scan node of the plurality of scan nodes during a predetermined pre-discharge time period according to a pre-discharge signal includes:

employing the dead time before lighting up the predetermined light emitting device in the frame as the predetermined pre-discharge time period according to a pixel data storage signal in an Eco pre-discharge mode; and controlling a plurality of pre-discharge switches during the predetermined pre-discharge time period to electrically connect the scan node of the scan line corresponding to the light emitting device which has been lit up just before the predetermined light emitting device to the pre-discharge level;

wherein the pixel data storage signal is configured to operably indicate a timing arrangement for lighting up the plurality of light emitting devices;

wherein the plurality of pre-discharge switches are coupled to the plurality of scan nodes correspondingly.

43. The control method of claim 39, wherein the step of providing a pre-discharge level to at least one predetermined scan node of the plurality of scan nodes during a predetermined pre-discharge time period according to a pre-discharge signal includes: in a first performance pre-discharge mode, employing each dead time in the frame plus a performance time immediately before each dead time in the frame as the predetermined pre-discharge time period and providing the pre-discharge level to all of the scan nodes during the predetermined pre-discharge time period according to the pre-discharge signal.

44. The control method of claim 39, wherein the step of providing a pre-discharge level to at least one predetermined scan node of the plurality of scan nodes during a predetermined pre-discharge time period according to a pre-discharge signal includes:

in a second Eco pre-discharge mode, employing the dead time before lighting up the predetermined light emitting device plus a performance time immediately before the dead time in the frame as the predetermined pre-discharge time period according to a pixel data storage signal; and controlling a plurality of pre-discharge switches during the predetermined pre-discharge time period to electrically connect the scan node of the scan line corresponding to the light emitting device which has been lit up just before the predetermined light emitting device to the pre-discharge level;

wherein the pixel data storage signal is configured to operably indicate a timing arrangement for lighting up the plurality of light emitting devices;

wherein the plurality of pre-discharge switches are coupled to the plurality of scan nodes correspondingly.

45. The control method of claim 39, further comprising: providing a pre-charge level to at least one predetermined data node of the plurality of data nodes during a predetermined pre-charge time period according to a pre-charge signal; wherein the predetermined pre-charge time period is correlated with the dead time.

46. The control method of claim 45, wherein in a normal pre-charge mode, there are a plurality of predetermined pre-charge time periods and a plurality of dead times in one frame, and wherein the step of providing a pre-charge level to at least one predetermined data node of the plurality of data nodes during a predetermined pre-charge time period according to a pre-charge signal includes: employing the plurality of dead times in the frame as the plurality of predetermined pre-charge time periods according to the pre-charge signal in a normal pre-charge mode and providing the pre-charge level to all of the data nodes during the plurality of predetermined pre-charge time periods.

47. The control method of claim 45, wherein the step of providing a pre-charge level to at least one predetermined data node of the plurality of data nodes during a predetermined pre-charge time period according to a pre-charge signal includes:

employing the dead time before lighting up the predetermined light emitting device in the frame as the predetermined pre-charge time period according to a pixel data storage signal in an Eco pre-charge mode; and controlling a plurality of pre-charge switches during the predetermined pre-charge time period to electrically connect the data node of the data line corresponding to the light emitting device which has been lit up just before the predetermined light emitting device to the pre-charge level;

wherein the pixel data storage signal is configured to operably indicate a timing arrangement for lighting up the plurality of light emitting devices;

wherein the plurality of pre-charge switches are coupled to the plurality of data nodes correspondingly.

48. The control method of claim 45, wherein the step of providing a pre-charge level to at least one predetermined data node of the plurality of data nodes during a predetermined pre-charge time period according to a pre-charge signal includes: in a first performance pre-charge mode, employing each dead time in the frame plus a performance time immediately before each dead time in the frame as the predetermined pre-charge time period according to the pre-charge signal, and providing the pre-charge level to all of the data nodes during the predetermined pre-charge time period.

49. The control method of claim 45, wherein the step of providing a pre-charge level to at least one predetermined data node of the plurality of data nodes during a predetermined pre-charge time period according to a pre-charge signal includes:

in a second Eco pre-charge mode, employing the dead time before lighting up the predetermined light emitting device plus a performance time immediately before the dead time in the frame as the predetermined pre-charge time period according to a pixel data storage signal; and controlling a plurality of pre-charge switches during the predetermined pre-charge time period to electrically connect the data node of the data line corresponding to the light emitting device which has been lit up just before the predetermined light emitting device to the pre-charge level;

wherein the pixel data storage signal is configured to operably indicate a timing arrangement for lighting up the plurality of light emitting devices;

wherein the plurality of pre-charge switches are coupled to the plurality of data nodes correspondingly.

50. The control method of claim 45, further comprising:

in a pre-charge charge sharing mode, controlling a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame so as to achieve charge sharing between the two data nodes;

wherein the plurality of pre-charge switches are coupled to the plurality of data nodes correspondingly;

wherein the data node of the data line corresponding to the light emitting device which has been lit up just before the predetermined light emitting device is addressed by a pixel data storage signal.

51. The control method of claim 39, further comprising:

in a pre-discharge charge sharing mode, controlling a plurality of pre-discharge switches to electrically connect the scan node of the scan line corresponding to the light emitting device which has been lit up just before the predetermined light emitting device to the scan node of the scan line corresponding to the predetermined light emitting device during a forepart time of the dead time before lighting up the predetermined light emitting device in the frame so as to achieve charge sharing between the two scan nodes;

wherein the plurality of pre-discharge switches are coupled to the plurality of scan nodes correspondingly;

wherein the scan node of the scan line corresponding to the light emitting device which has been lit up just before the predetermined light emitting device is addressed by a pixel data storage signal.

52. A control method of a light emitting device array circuit, wherein the light emitting device array circuit is configured to operably control a light emitting device array, wherein the light emitting device array includes a plurality of light emitting devices which are arranged in a plurality of scan lines and a plurality of data lines, wherein forward ends of the plurality of light emitting devices in each scan line are commonly coupled to a scan node and reverse ends of the plurality of light emitting devices in each data line are commonly coupled to a data node; the control method comprising:

in a frame, electrically connecting the plurality of scan nodes to a scan conduction voltage in a non-overlapping sequential order;

when the scan nodes are electrically connected to the scan conduction voltage, providing predetermined dimming levels to the predetermined data nodes respectively according to data operation signals, so as to light up the light emitting devices corresponding to the data nodes and determine corresponding luminance;

providing a pre-charge level to at least one predetermined data node of the plurality of data nodes during a predetermined pre-charge time period according to a pre-charge signal;

wherein there is a dead time between a time point at which providing the predetermined dimming level to one of the data nodes is changed to not providing the predetermined dimming level to said one of the data nodes and a time point at which not providing the predetermined dimming level to another one of the data nodes which corresponds to the light emitting device to be lit up in a next scan line is changed to providing the predetermined dimming level to said another one of the data nodes;

wherein the predetermined pre-charge time period is correlated with the dead time.

53. The control method of claim 52, wherein there are a plurality of predetermined pre-charge time periods and a plurality of dead times in one frame, and wherein the step of providing a pre-charge level to at least one predetermined data node of the plurality of data nodes during a predetermined pre-charge time period according to a pre-charge signal includes: in a normal pre-charge mode, employing the plurality of dead times in the frame as the plurality of predetermined pre-charge time periods according to the pre-charge signal and providing the pre-charge level to all of the data nodes during the plurality of predetermined pre-charge time periods.

54. The control method of claim 52, wherein the step of providing a pre-charge level to at least one predetermined data node of the plurality of data nodes during a predetermined pre-charge time period according to a pre-charge signal includes:

employing the dead time before lighting up the predetermined light emitting device in the frame as the predetermined pre-charge time period according to a pixel data storage signal in an Eco pre-charge mode; and controlling a plurality of pre-charge switches during the predetermined pre-charge time period to electrically connect the data node of the data line corresponding to the light emitting device which has been lit up just before the predetermined light emitting device to the pre-charge level;

wherein the pixel data storage signal is configured to operably indicate a timing arrangement for lighting up the plurality of light emitting devices;

wherein the plurality of pre-charge switches are coupled to the plurality of data nodes correspondingly.

55. The control method of claim 52, wherein the step of providing a pre-charge level to at least one predetermined data node of the plurality of data nodes during a predetermined pre-charge time period according to a pre-charge signal includes: in a first performance pre-discharge mode, employing each dead time in the frame plus a performance time immediately before each dead time in the frame as the predetermined pre-discharge time period and providing the pre-discharge level to all of the scan nodes during the predetermined pre-discharge time period according to the pre-discharge signal.

56. The control method of claim 52, wherein the step of providing a pre-charge level to at least one predetermined data node of the plurality of data nodes during a predetermined pre-charge time period according to a pre-charge signal includes:

employing the dead time before lighting up the predetermined light emitting device plus a performance time immediately before the dead time in the frame as the predetermined pre-charge time period according to a pixel data storage signal in a second Eco pre-charge mode; and controlling a plurality of pre-charge switches during the predetermined pre-charge time period to electrically connect the data node of the data line corresponding to the light emitting device which has been lit up just before the predetermined light emitting device to the pre-charge level;

wherein the pixel data storage signal is configured to operably indicate a timing arrangement for lighting up the plurality of light emitting devices;

wherein the plurality of pre-charge switches are coupled to the plurality of data nodes correspondingly.

57. The control method of claim 52, further comprising:

in a pre-charge charge sharing mode, controlling a plurality of pre-charge switches to electrically connect the data node of the data line corresponding to the light emitting device which has been lit up just before the predetermined light emitting device to the data node of the data line corresponding to the predetermined light emitting device during a forepart time of the dead time before lighting up the predetermined light emitting device in the frame, so as to achieve charge sharing between the two data nodes;

wherein the plurality of pre-charge switches are coupled to the plurality of data nodes correspondingly;

wherein the data node of the data line corresponding to the light emitting device which has been lit up just before the predetermined light emitting device is addressed by a pixel data storage signal.

* * * * *